US006792230B2

(12) United States Patent
Saito et al.

(10) Patent No.: US 6,792,230 B2
(45) Date of Patent: Sep. 14, 2004

(54) IMAGE FORMING APPARATUS AND PROCESS CARTRIDGE AND DEVELOPING UNIT FOR THE IMAGE FORMING APPARATUS WITH EFFICIENT TONER REPLENISHING

(75) Inventors: Manabu Saito, Iwatsuki (JP); Hidekazu Amamoto, Iwatsuki (JP); Atsuna Saiki, Iwatsuki (JP); Takaharu Abe, Iwatsuki (JP)

(73) Assignee: Fuji Xerox Co., Ltd, Tokyo (JP)

( * ) Notice: Subject to any disclaimer, the term of this patent is extended or adjusted under 35 U.S.C. 154(b) by 0 days.

(21) Appl. No.: 10/226,305

(22) Filed: Aug. 23, 2002

(65) Prior Publication Data

US 2003/0118368 A1 Jun. 26, 2003

(30) Foreign Application Priority Data

Dec. 20, 2001 (JP) ..... 2001-388372

(51) Int. Cl.[7] ..... G03G 15/00
(52) U.S. Cl. ..... 399/111; 399/120; 399/405
(58) Field of Search ..... 399/111, 113, 399/120, 258, 260, 262, 257, 224, 302, 300, 405

(56) References Cited

U.S. PATENT DOCUMENTS 5,126,799 A * 6/1992 Matsuura et al. ..... 399/110
5,289,241 A * 2/1994 Sugiyama et al. ..... 399/120
5,315,362 A * 5/1994 Fuji et al. ..... 141/258
5,543,891 A * 8/1996 Setoriyama ..... 399/111
5,729,804 A * 3/1998 Aruga et al. ..... 399/263
6,081,683 A * 6/2000 Miyasaka et al. ..... 399/302
6,463,234 B2 * 10/2002 Arimitsu et al. ..... 399/113
6,549,737 B2 * 4/2003 Sano et al. ..... 399/111

FOREIGN PATENT DOCUMENTS

JP 7-168507 A * 7/1995
JP 8-123297 * 5/1996

* cited by examiner

*Primary Examiner*—Quana Grainger
(74) *Attorney, Agent, or Firm*—Oliff & Berridge, PLC

(57) ABSTRACT

An image forming apparatus has a latent image forming unit for forming a latent image on an image carrying body and a developing unit for visualizing the latent image formed on the image carrying body by using a developer. In the image forming apparatus, for the developing unit, a developer replenishment box is communicatively connected to a developing housing in which a developer is contained, and the developer replenishment box is disposed in an upstream of a latent image writing position P on the image carrying body. The developer replenishment box is contained in a process cartridge.

16 Claims, 23 Drawing Sheets

IMAGE FORMING APPARATUS AND PROCESS CARTRIDGE AND DEVELOPING UNIT FOR THE IMAGE FORMING APPARATUS WITH EFFICIENT TONER REPLENISHING

The present disclosure relates to the subject matter contained in Japanese Patent Application NO. 2001-388372 filed on Dec. 20, 2001, which is incorporated herein by reference in its entirety.

BACKGROUND OF THE INVENTION

1. Field of the Invention

The present invention relates to an image forming apparatus, such as a copying machine and a printer. More particularly, the invention relates to an image forming apparatus of a type which visualizes a latent image on an image carrying body by using a developer, and a process cartridge and a developing unit, which are both used for the image forming apparatus.

2. Description of the Related Art

In an electrophotographic machine as a typical example of this type of image forming apparatus, a latent image is formed on an image carrying body such as a photosensitive drum, by a scanning light beam emitted from an optical unit, for example. The latent image is visualized (developed) by using the developer, and transferred onto a recording sheet, such as a recording paper.

In this case, if a two-component developing system, for example, is used, as the toner consumption progresses, toner or toner and carrier are periodically replenished (JP-B-6-12475).

In this type of the technique, an image is transferred onto the image carrying body, while transporting the recording sheet in the substantially vertical direction, and scanning light is laterally incident on the image carrying body.

In this case, a toner replenishment box is disposed in downstream (in a lower part in this instance) of a latent image writing position on the image carrying body. Accordingly, the toner replenishment box does not hinder the operation of writing the latent image onto the image carrying body.

However, in this type of technique, the toner replenishment box is disposed in downstream (in a lower part in this instance) of a scanning light incident position. Therefore, for example, when the amount of toner is increased, the toner amount increase more easily affects the positions of a sheet tray and the optical unit, which are disposed in the lower part, since the volume of the toner replenishment box is increased. Changes to the specification of the machine, caused by the toner replenishing amount change, are not uniform. This makes it difficult to use the image forming apparatus in common for different specifications. An additional problem is that with increase of the toner replenishing amount, the machine size tends to increase.

Further, in a case where the machine is designed so as to allow the toner replenishment box to be pulled out from an upper part of the machine body, it entails that it is difficult to install another device in an upper space of the toner replenishment box. An additional technical problem arises that a dead space is easy to be formed in upstream (in an upper part in this instance) of the scanning light incident position.

Particularly in a case where the process cartridge is equipped with the toner replenishment box, such a technical problem is more remarkable by the amount of its occupied space increase.

SUMMARY OF THE INVENTION

The present invention has been made to solve the problems described above. An object of the invention is to provide an image forming apparatus, which is capable of efficiently securing a replenishing function of a developer while satisfying requirements of the size reduction and common usability of the image forming apparatus, and with a minimum chance of forming dead space within the apparatus.

According to embodiments of the invention, there is provided an image forming apparatus including a latent image forming unit and a developing unit. The latent image forming unit forms a latent image on an image carrying body. The developing unit visualizes the latent image formed on the image carrying body by using a developer. A developing housing containing the developer is communicatively connected to a developer replenishment box. The developer replenishment box is disposed in an upstream of a latent image writing position on the image carrying body.

DESCRIPTION OF THE INVENTION

Figure 1:
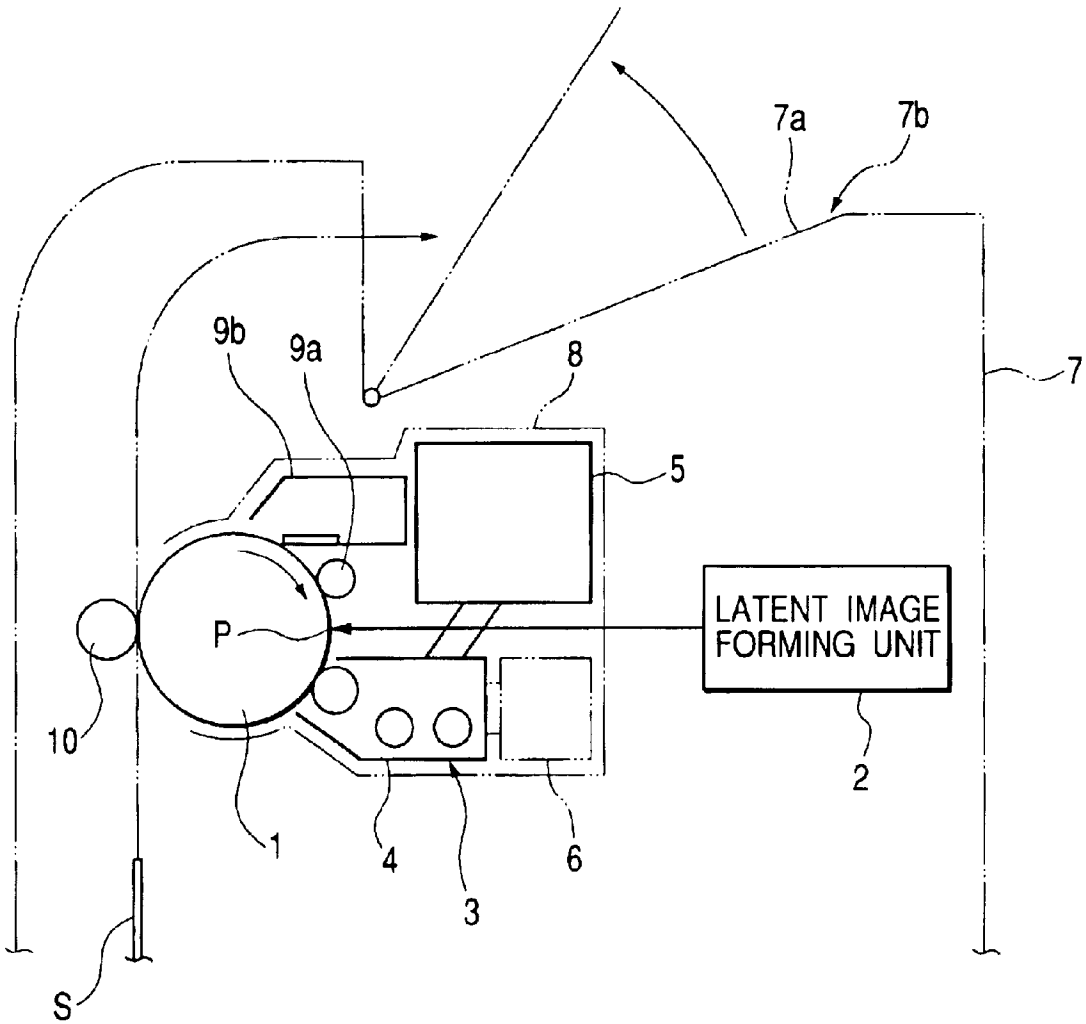
FIG. 1 is an explanatory diagram interrelatedly showing an image forming apparatus, a process cartridge, and a developing unit, which are based on the present invention.

According to the present invention, an image forming apparatus has a latent image forming unit 2 and a developing unit 3 as shown in FIG. 1. The latent image forming unit 2 forms a latent image on an image carrying body 1. The developing unit 3 visualizes the latent image formed on the image carrying body 1 by using a developer. For the developing unit 3, a developer replenishment box 5 is communicatively connected to a developing housing 4 in which a developer is contained. The developer replenishment box 5 is disposed in upstream of a latent image writing position P on the image carrying body 1.

It will be understood that the invention can be applied to every image forming apparatus of a type in which a latent image is visualized by the developing unit 3. The invention may be applied to not only the monochrome machine but also the color machine of the tandem type in which a plurality of image carrying bodies 1 are arrayed.

For the developing unit 3, any kind of developer may be used if it is capable of replenishing the developer. The developer may be any of a two-component developer, a one-component developer, and a developer in which magnetic carrier is used for only a carrier medium for transporting supplied toner and the like.

The developer replenishment box 5 involves a variety of containers each capable of replenishing a developer (toner, toner+carrier).

The reason why the latent image writing position P is used as a reference position is that if the developer replenishment box 5 blocks the latent image writing position, it is impossible to form a latent image on the image carrying body 1.

Further, the reason why the wording "upstream of the latent image writing position P" is used is to include sheet paths other than the substantially vertically extending sheet path (in the case of an S-shaped sheet path, for example, the sheet path substantially horizontally extending sheet path is frequent).

The reason why the developer replenishment box 5 is disposed in upstream of the latent image writing position P is that the function of replenishing the developer is realized while effectively utilizing the space within the apparatus, and it is easy to cope with a change of the developer replenishing amount.

Further, this type of image forming apparatus preferably includes a process cartridge 8, which is detachably attached to an apparatus body 7, and into which the image carrying body 1 and at least one process unit 9 (9*a*: charging unit, for example, 9*b*: cleaning unit 9*b*, for example) are incorporated. The developer replenishment box 5 is preferably installed to the process cartridge 8.

In the embodiment, the process cartridge 8 maybe attached to and detached from the apparatus body 7, while containing the developer replenishment box 5.

The developer replenishment box 5 may be formed integrally with the process cartridge 8. However, it is preferable to detachably attach the developer replenishment box 5 to the process cartridge 8.

In this case, the developer replenishment box 5 may solely be replaced with another one, and the process cartridge 8 is effectively utilized.

It is also preferable that an image carrying body cartridge including at least the image carrying body 1 is detachably attached to the process cartridge 8.

In this case, the image carrying body cartridge may solely be replaced with another one, and the process cartridge 8 is effectively utilized.

Additionally, it is preferable that the process cartridge 8 may be attached to and detached from the apparatus body 7 from above, by opening an opening/closing cover 7*a* at the upper part of the apparatus body 7.

In this case, the attaching and detaching operations of the process cartridge 8 can be improved. To remove a recording sheet jammed near a transfer stage, user may access the jamming sheet by detaching the process cartridge 8. Thus, the opening/closing cover 7*a* is commonly used for both purposes of detaching the process cartridge 8 and removing the paper jam. As a result, the cost of the apparatus body 7 is reduced.

In a case where recovering of the waste developer is required, it is preferred that a waste developer recovering box 6 is integrally attached to the developer replenishment box 5.

The waste developer recovering box 6 involves a variety of containers for recovering the waste developer (which means mainly a deteriorated developer in the developing unit 3, but not exclusive of waste toner gathered after the cleaning).

According to the present invention, the replenishment of the developer and the recovering of the waste developer are simultaneously carried out (deteriorated developer, waste toner after the cleaning and the like) as well. In this case, there is no need of using an additional cartridge for collecting the waste developer, and the operability can be improved and the cost can be reduced.

The waste developer recovering box 6 is not provided separately from the developer replenishment box 5. Therefore, when the replenishing developer is used up and the developer replenishment box 5 is empty, the waste developer recovering box 6 is also replaced with another box forcibly. Accordingly, if design is made taking the volumes of the developer replenishment box 5 and the waste developer recovering box 6 into account, there is no need of detecting as to whether the waste developer recovering box 6 is full with the waste developer.

Even if the image forming apparatus includes any sheet path, no problem arises. In an image forming apparatus of a type in which a recording sheet S receiving a visual image from the image carrying body 1 by a transfer member 10 is transported from a lower part to an upper part, the developer replenishment box 5 may be disposed on the upper side of the latent image writing position P on the image carrying body 1.

In this case, since the developer replenishment box 5 is disposed in an upper part of the latent image writing position P, a freedom of the layout of the developer replenishment box 5 (it is easy to cope with the increase of the box volume) is increased. In this respect, it is preferable to dispose the developer replenishment box 5 so.

In an image forming apparatus of a type in which the waste developer recovering box 6 is attached to the developer replenishment box 5, the waste developer recovering box 6 may be attached to a desired position. For example, in the case of the waste developer recovering box 6 communicatively connected to the developing housing 4, it is preferable to dispose the waste developer recovering box 6 on the lower side of the latent image writing position P of the image carrying body 1.

Further, in an image forming apparatus of as type which includes a sheet path extending in a substantially vertical direction, a discharge tray 7*b* in which discharged sheets are contained is preferably provided on the upper side of the developer replenishment box 5.

In this case, the dead space under the discharge tray 7*b* may be effectively utilized for a space in which the developer replenishment box 5 is installed.

According to the invention, the upper surface housing of the developer replenishment box 5 is preferably a surface inclined in the same direction as of the discharge tray 7*b* in which the recording sheets S are contained.

According to the invention, a freedom of the layout of the developer replenishment box 5 is increased (it is easy to cope with the increase of the box volume), and realizing the size reduction of the image forming apparatus is realized by minimizing the dead space under the discharge tray 7*b*.

It is preferable that the developer replenishment box 5 is capable of containing a larger amount of developer than the developing housing 4 disposed on the lower side of the latent image writing position P on the image carrying body 1.

According to the invention, a freedom of the layout of the developer replenishment box 5 is increased (it is easy to cope with the increase of the box volume).

In an image forming apparatus which is provided with the sheet path extending in the substantially vertical direction, when the developer replenishment box 5 and the developing housing 4 are separately laid out to sandwich the latent image writing position P on the image carrying body 1 therebetween, the developer replenishment box 5 is disposed in an upper part of the latent image writing position P on the image carrying body 1, and the developing housing 4 is disposed in a lower part of the latent image writing position P. It is preferable that the developer replenishment box 5 is communicatively connected to the developing housing 4 by way of a communicative passage, which makes a detour around the latent image writing position P.

The embodiment effectively utilizes the space within the machine, reduces the size of the developing unit 3, and realizes the developer replenishment.

In an image forming apparatus of the type in which the sheet path is substantially vertically directed, and an intermediate transfer member is used, an image forming apparatus has a latent image forming unit 2, a developing unit 3, and an intermediate transfer member (not shown). The latent image forming unit 2 forms a latent image on an image carrying body 1. The developing unit 3 visualizes the latent image formed on the image carrying body 1 by using a developer. The intermediate transfer member temporarily holds the visual image formed on the image carrying body 1, and transfers the visual image onto a recording sheet S. The recording sheet S is transported from a lower part to an upper part.

In this case, for the developing unit 3, a developer replenishment box 5 is communicatively connected to a developing housing 4 in which a developer is contained, and the developing housing 4 and the developer replenishment box 5 are disposed in an upper part of a latent image writing position P on the image carrying body 1. According to the invention, a space under the latent image writing position P on the image carrying body 1 is minimized, and hence the vertical size of the apparatus is reduced.

The intermediate transfer member used is required for enabling the transferring of the visual image to the recording sheet S moving in the substantially vertical direction.

The present invention is not limited to the image forming apparatus mentioned above, but may be applied to the single units i.e., the process cartridge 8 and the developing unit 3, which are used in the image forming apparatus, as shown in FIG. 1.

DETAILED DESCRIPTION OF THE PREFERRED EMBODIMENTS

Preferred embodiments of the present invention will be described in detail with reference to the accompanying drawings.

<Embodiment 1>

Figure 2:
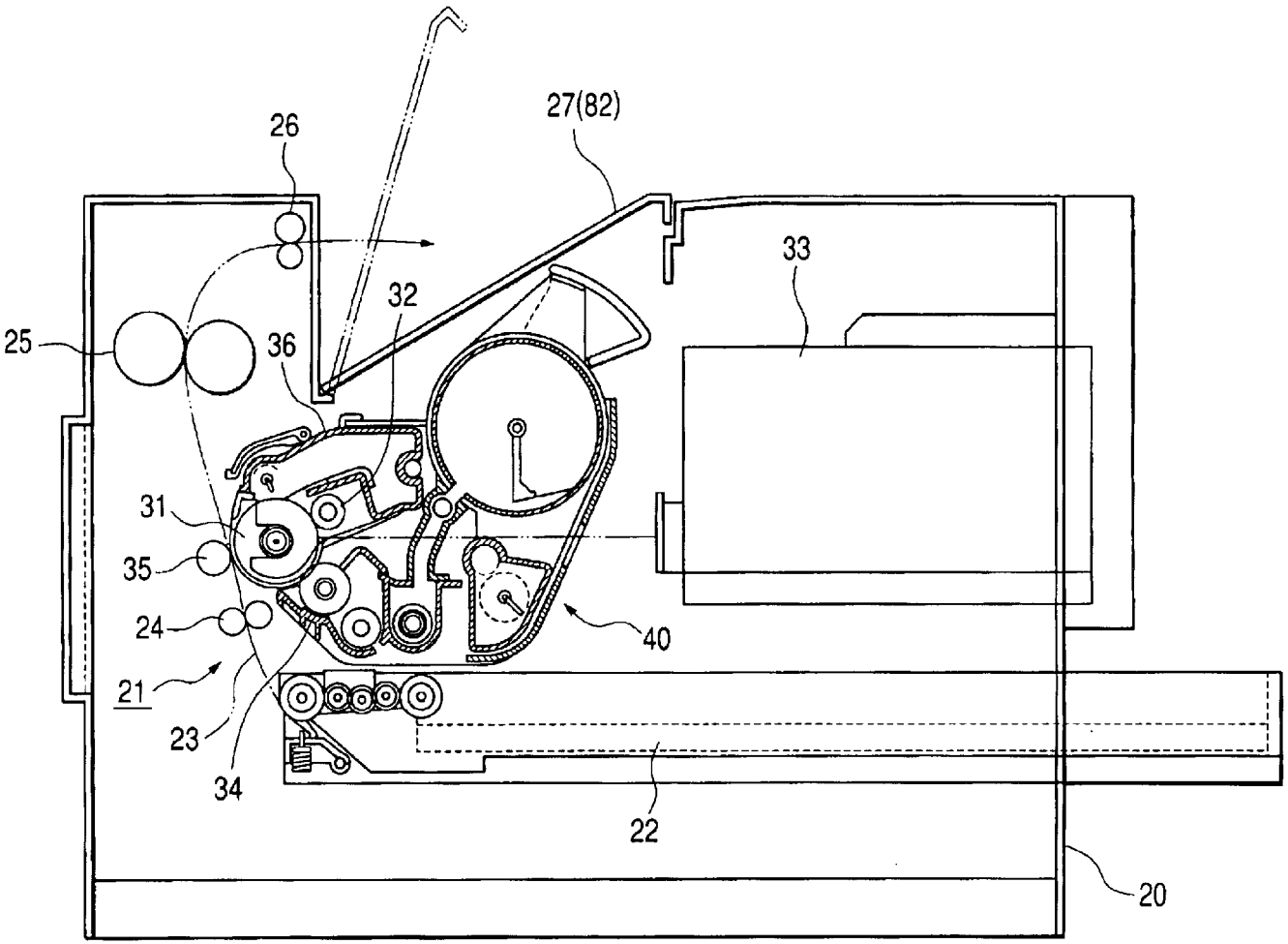
FIG. 2 is an explanatory diagram for explaining an overall construction of an image forming apparatus which forms an embodiment 1 of the invention.

FIG. 2 is an explanatory diagram for explaining an embodiment 1 of an image forming apparatus according to the present invention.

In the figure, the image forming apparatus includes an image forming engine 21, for example, employing an electrophotography system, a sheet supply unit 22, a discharge tray 27, and a sheet transporting path 23. The image forming engine 21 is installed in an apparatus body 20. The sheet supply unit 22 is disposed under the image forming engine 21 in the apparatus body 20. An upper part of the apparatus body 20 is formed as the discharge tray 27. The sheet transporting path 23 is disposed in a rear part (a left side in FIG. 2) in the apparatus body 20 and substantially extends in a vertical direction. The sheet transporting path 23 leads a recording sheet S, which comes from the sheet supply unit 22, to the image forming engine 21 and the discharge tray 27.

In the instant embodiment, the image forming engine 21 is based on the electrophotography system, for example. The image forming engine 21 includes a photosensitive drum 31, a charging unit 32 (charging roll in this instance), an exposure unit 33, a developing unit 34, a transfer unit 35, and a cleaning unit 36. The charging unit 32 charges the photosensitive drum 31. The exposure unit 33 such as a laser scanning device writes an electrostatic latent image (hereinafter referred to as a latent image) on the charged photosensitive drum 31. The developing unit 34 develops the latent image on the photosensitive drum 31 by using toner. The transfer unit (transfer roll in this instance) 35 transfers a visual image (toner image) formed on the photosensitive drum 31 onto the recording sheet S. The cleaning unit 36 removes toner left on the photosensitive drum 31 to clean the photosensitive drum 31.

A register roller 24 for positioning the recording sheet S is provided in an upstream of the photosensitive drum 31 on the sheet transporting path 23. A fixing unit 25 is disposed in a downstream of the photosensitive drum 31 on the sheet transporting path 23. A discharge roll 26 is provided immediately before a discharge tray 27.

In the embodiment, most of devices of the image forming engine 21 are incorporated into a process cartridge 40.

Figure 3:
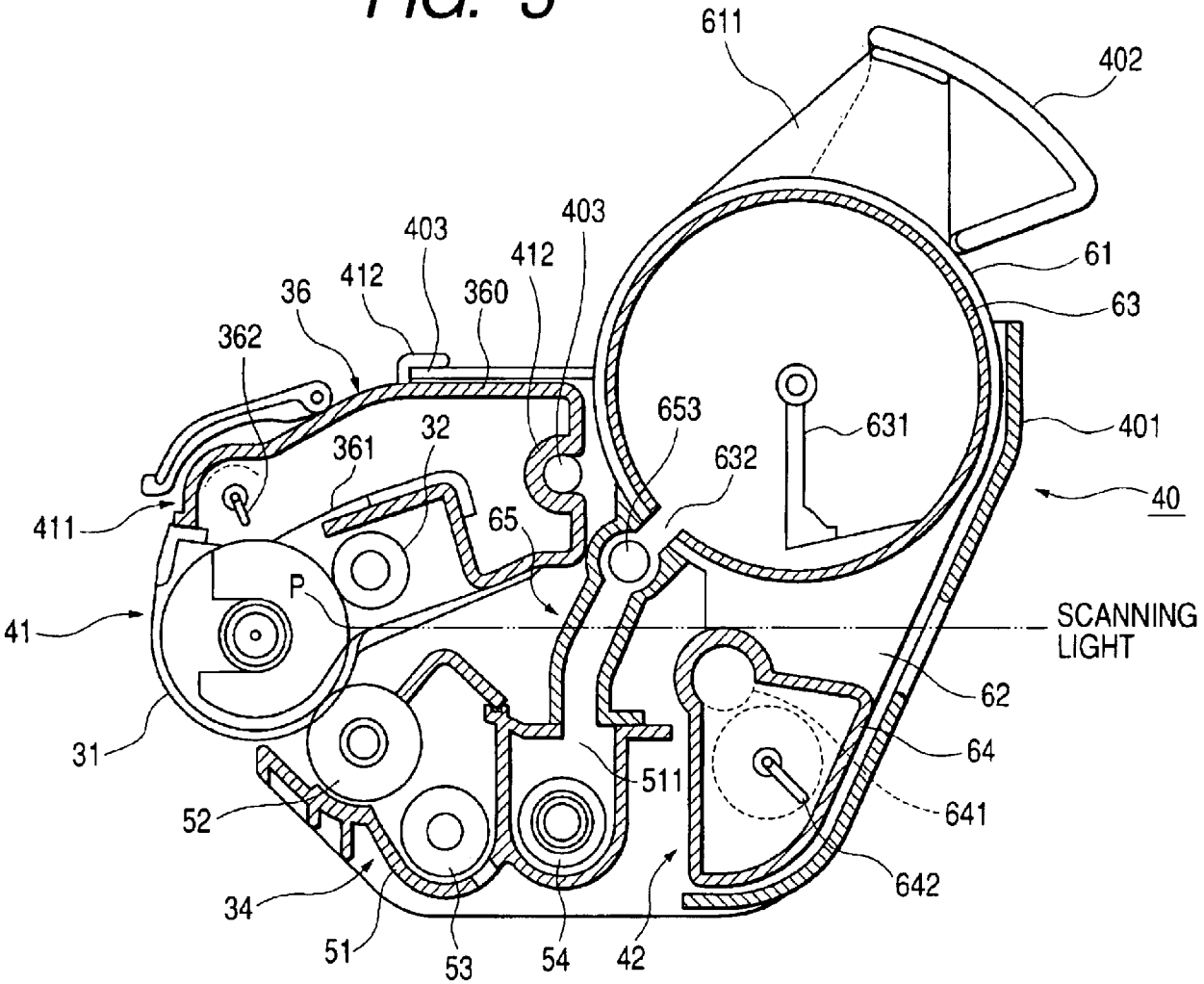
FIG. 3 is an explanatory diagram for explaining the details of a process cartridge used in the embodiment.

Specifically, the process cartridge 40 used in the instant embodiment, as shown in FIGS. 2 and 3, contains the photosensitive drum 31, charging unit 32, developing unit 34 and cleaning unit 36. The process cartridge 40 is detachably attached to the apparatus body 20. That is, the process cartridge 40 is constructed as so called CRU (customer replaceable unit).

In the instant embodiment, the photosensitive drum 31, charging unit 32 and cleaning unit 36 integrally form a photosensitive cartridge 41. The photosensitive cartridge is detachably attached to the process cartridge 40.

In the photosensitive cartridge 41, the charging unit 32 is disposed in an upstream (on the upper side in this instance) of the latent image writing position P on the photosensitive drum 31. Further, the cleaning unit 36 is disposed in the further upstream thereof.

In the instant embodiment, in the cleaning unit 36, a part of the cartridge case 411 is formed as a cleaning case 360. The cleaning unit 36 includes a cleaning blade 361, which is provided at an opening edge of the cleaning case 360 and in contact with the photosensitive drum 31, and a transporting paddle 362, provided near the opening of the cleaning case 360, for transporting toner left after the cleaning by the cleaning blade 361 to the inner part of the cleaning case 360.

Figure 4:
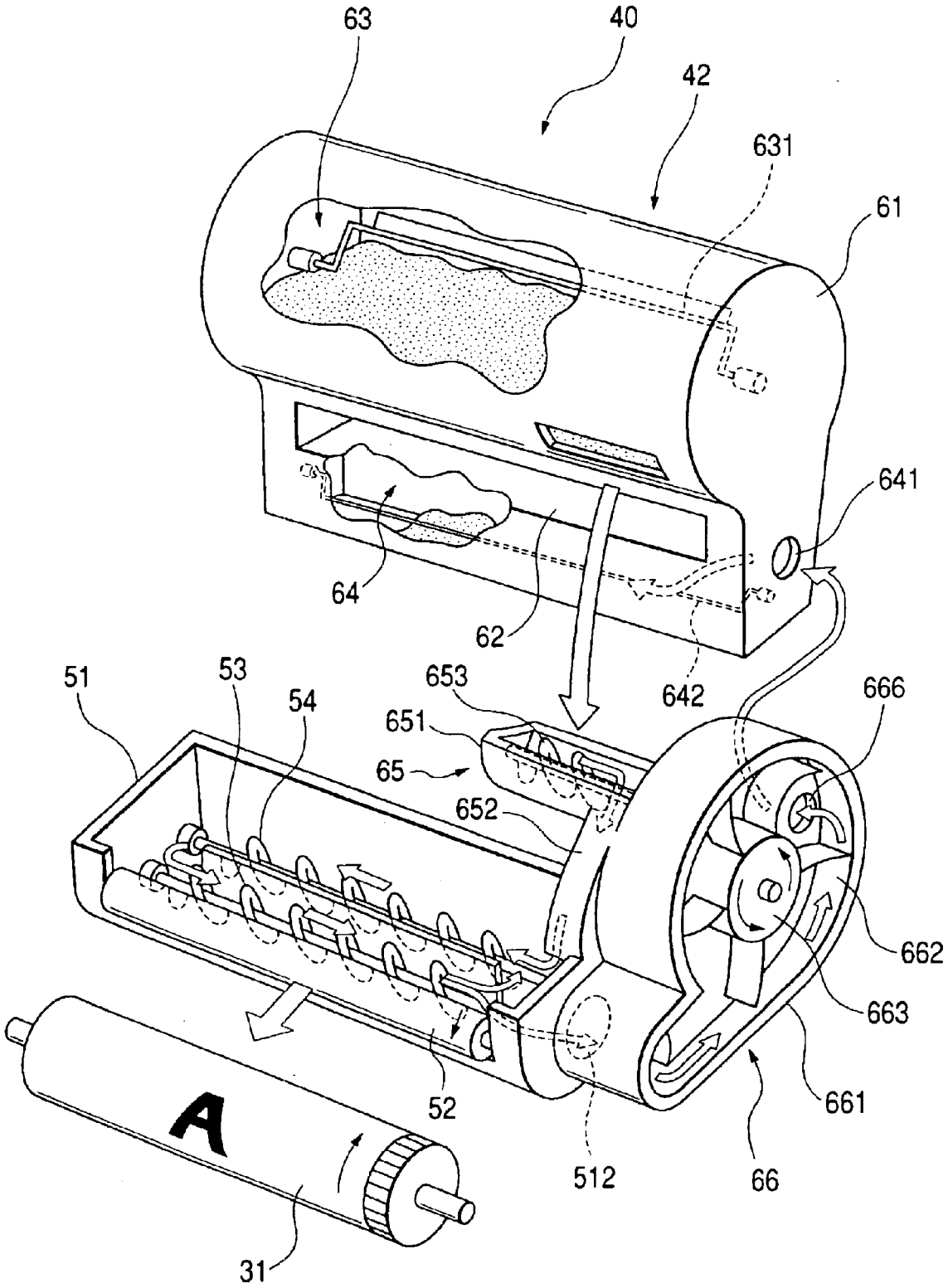
FIG. 4 is an exploded perspective view showing a major portion of the process cartridge including a waste developer transporting mechanism.

The developing unit 34 is based on the two-component development. As shown in FIGS. 3 and 4, the developing unit includes a developing housing 51 which is located in the downstream (on the lower side in this instance) of the latent image writing position P of the photosensitive drum 31 and opened to the photosensitive drum 31 side. A developing roll 52 is disposed facing the opening of the developing housing 51. A pair of agitating/transporting augers 53 and 54 by which the developer is agitated and transported are provided on the rear side of the developing roll 52. The developer agitated and transferred by the agitating/transporting augers 53 and 54 is transferred to the developing roll 52. A developer layer on the developing roll 52 is regulated in thickness by a trimming member (not shown), and the developer is supplied to a developing position on the photosensitive drum 31.

Further, the developing unit 34 includes a toner cartridge 42, which is located on the rear side of the developing housing 51.

The toner cartridge 42, as shown in FIGS. 3 and 4, is vertically extended astride the latent image writing position P on the photosensitive drum 31. A scanning passage 62 along which scanning light beam emitted from the exposure unit 33 passes is formed at a location of the cartridge case 61, which corresponds to the latent image writing position P. A toner replenishment box 63 is disposed in the upstream (on the upper side in this instance) of the latent image writing position P in the cartridge case 61. A waste developer recovering box 64 is disposed in the downstream(on the lower side in the instance) of the latent image writing position P.

In the instant embodiment, the toner replenishment box 63 is a cylindrical box extending in the axial direction of the developing roll 52. A toner agitator 631 is disposed within this, and agitates and mixes toner so as to prevent the toner from being clustered.

A toner replenishment duct 65 is communicatively connected between the toner replenishment box 63 and the developing housing 51. The toner replenishment duct 65 is positioned out of the scanning passage 62 so as not to interrupt the scanning passage 62.

The toner replenishment duct 65 includes a toner receiving part 651, which correspond to an elongated replenishment port 632 bored in a part of the toner replenishment box 63. The toner replenishment duct includes a connection pipe portion 652, which is communicatively connected from the outer side end of the toner receiving part 651 (as longitudinally viewed) to a replenishment port 511 of the developing housing 51 (which is located at a position which is lower than the replenishment port 632 of the toner replenishment box 63). A dispense auger 653 for supplying the received toner to the connection pipe portion 652 at a rate of a predetermined amount of toner is disposed within the toner receiving part 651.

In the present embodiment, the waste developer recovering box 64 is a box having a deformed fan-shape in cross section, which extends in the axial direction of the developing roll 52. A recovering port 641 is formed at an upper part of the side end of the waste developer recovering box, and a smooth agitator 642 for smoothing the collected waste developer is disposed within the waste developer recovering box.

A discharge port 512 for discharging the waste developer out of the developing housing 51 (the discharge port 512 is located at a position which is lower than the recovering port 641) is bored at one side end of the developing housing 51 as longitudinally viewed. The deteriorated developer is periodically discharged from the developing housing 51, through the discharge port 512.

One or a plurality of discharge ports 512 may be formed at a predetermined height in a normally open state. If required, a shutter, which is opened and closed at appropriate timings, may additionally be provided in association with the discharge port.

A waste developer transporting mechanism 66 is provided between the recovering port 641 of the waste developer recovering box 64 and the discharge port 512 of the developing housing 51.

Figure 5:
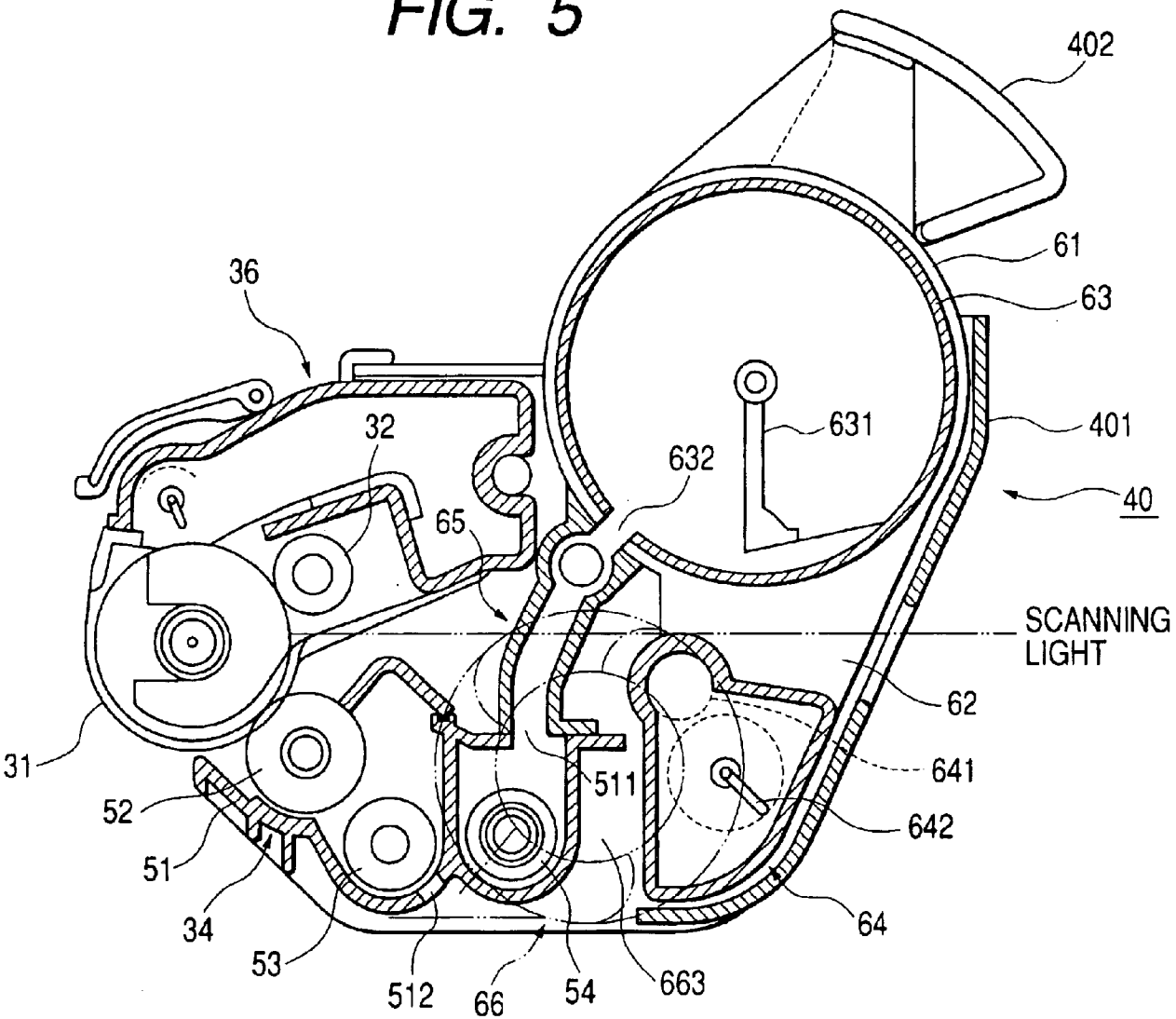
FIG. 5 is an explanatory diagram for explaining the details of the process cartridge including a waste developer transporting mechanism.
Figure 6A:
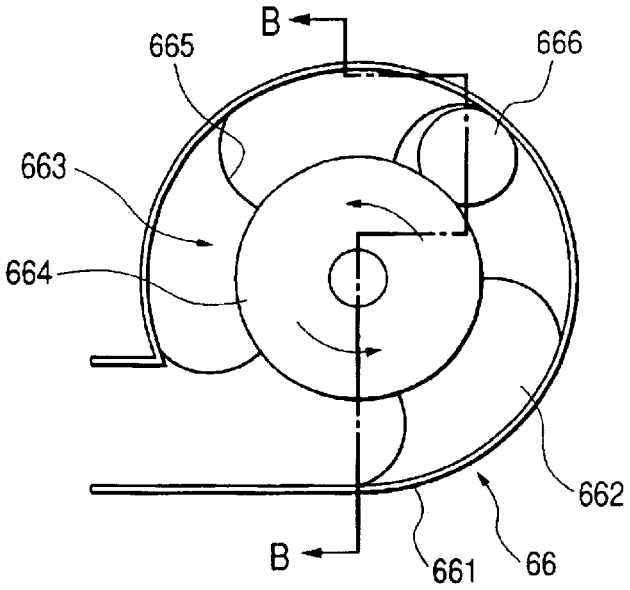
FIG. 6A is an explanatory diagram for explaining the waste developer transporting mechanism.
Figure 6B:
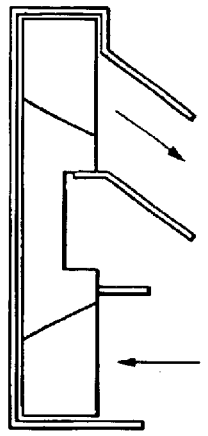
FIG. 6B is a cross sectional view taken on line B—B in FIG. 6A.

The waste developer transporting mechanism 66, as shown in FIGS. 4 to 6, is disposed on the side of the developing housing 51 and the toner cartridge 42. The recovering port 641 of the waste developer recovering box 64 and the discharge port 512 of the developing housing 51 are interconnected by a connecting duct 661 in a sealing fashion. A part of the connecting duct 661 forms a ring-like space part 662, and a recovering fin 663 is disposed within the ring-like space part 662.

In the recovering fin 663, a plurality of fin members 665 are disposed around the rotor 664 at predetermined angular intervals. The recovering port 641 is disposed at a position of the connecting duct 661 defining the ring-like space part 662, which the position faces a fin moving locus of the recovering fin 663. A communicating port 666 is bored at a part corresponding to the recovering port 641. If the recovering fin 663 is manufactured by resin molding or the like, the cost of it may be reduced.

In the embodiment, the process cartridge 40, as shown in FIG. 3, for example, includes each photosensitive cartridge 41, toner cartridge 42, and a cartridge holder 401 for holding another device. A movable holder 402 for holding down the toner cartridge 42 is provided in the cartridge holder 401 in a swingable manner. By removing an engaging state of the movable holder 402 with an engaging piece 611 of the toner cartridge 42, the toner cartridge 42 is separated from the cartridge holder 401. In FIG. 4, the engaging piece 611 of the toner cartridge 42 is not illustrated.

The process cartridge 40 is provided with a drive force transmitting system 70.

Figure 7:
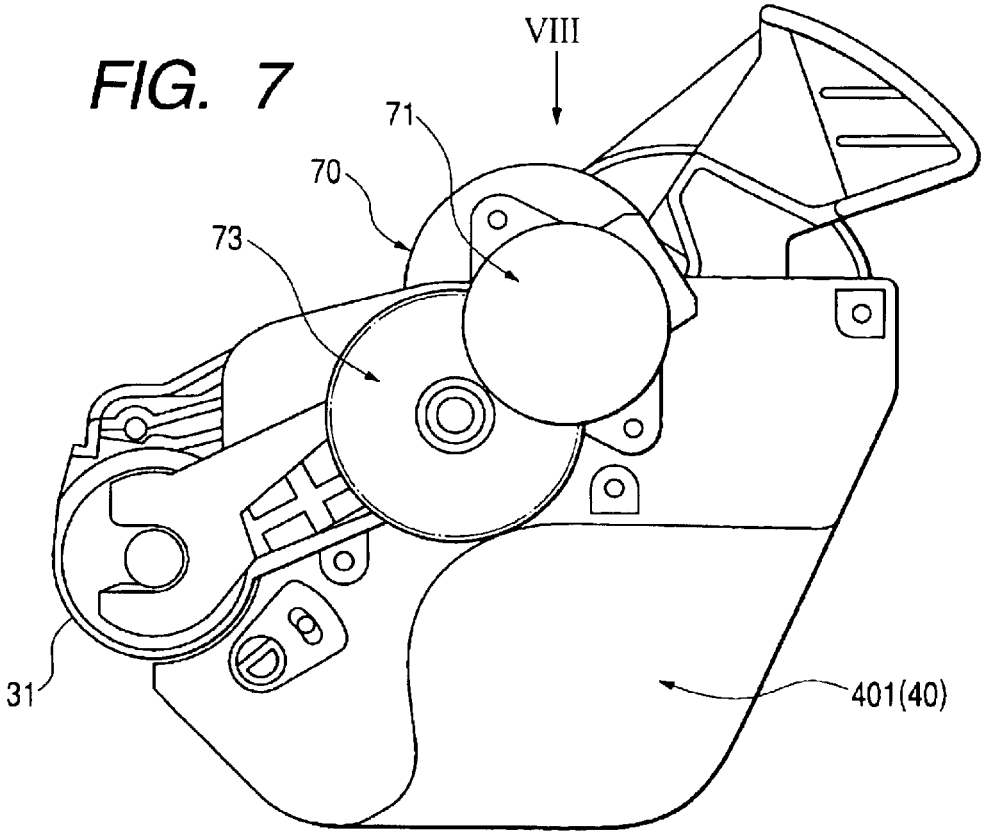
FIG. 7 is an explanatory diagram for explaining a drive force transmitting system of the process cartridge.
Figure 8:
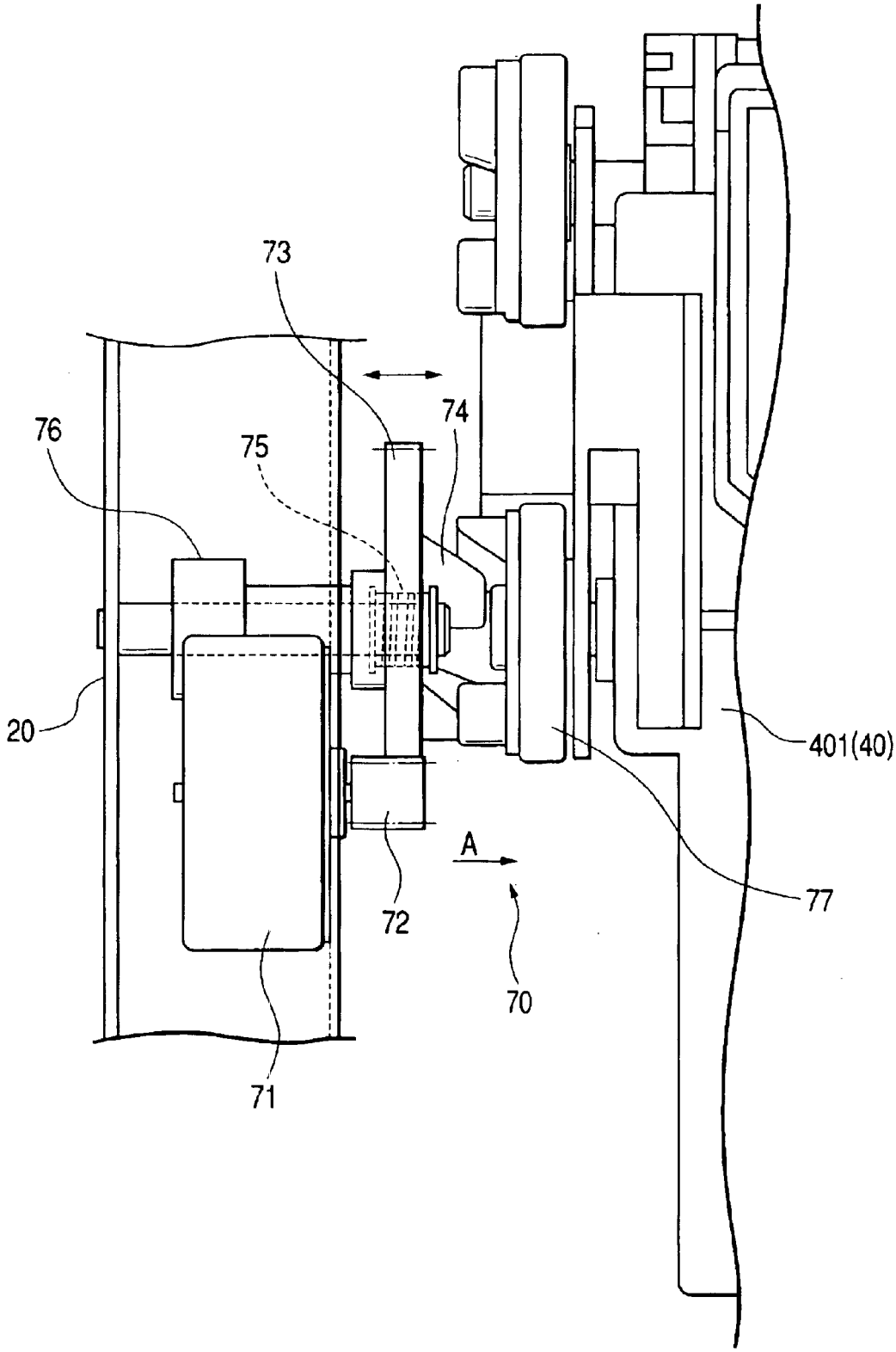
FIG. 8 is a view taken in an arrow direction VIII in FIG. 7.

In the drive force transmitting system 70, as shown in FIGS. 7 and 8, a drive motor 71 is fastened to the apparatus body 20. A drive coupling gear 73, which is in mesh with a drive shaft gear 72 of the drive motor 71, is provided with a drive side coupling 74. The developing unit 3 is axially movably supported with respect to the apparatus body 20. The drive coupling gear 73 is urged, by an urging spring 75, in such a direction as to move the drive coupling gear apart from the process cartridge 40. The drive shaft gear 72 and the drive coupling gear 73 are both helical gears. A torque limiter 76 is attached to the shaft of the drive coupling gear 73.

The cartridge holder 401 of the process cartridge 40 includes a CRU side coupling 77, which is removably coupled with the drive side coupling 74.

In the embodiment, the drive force transmitting system 70 operates in the following manner.

When the drive motor 71 is rotated in a predetermined direction, and its rotational force is transmitted, a thrust force having an arrow direction A is generated at a part where the drive shaft gear 72 is in mesh with the drive coupling gear 73, by the rotational direction of the motor and the load of the torque limiter 76. By the thrust force, the drive side coupling 74 is coupled with the CRU side coupling 77, while resisting the urging force by the urging spring 75.

When the drive motor 71 stops, the thrust force disappears at the meshing part between the drive shaft gear 72 and the drive coupling gear 73. As a result, the drive side coupling 74 retracts by the urging force of the urging spring 75, and the drive side coupling 74 is decoupled from the CRU side coupling 77.

To decouple those couplings one from the other, the drive motor 71 is rotated in the direction opposite to the direction in which the motor is rotated when those couplings are coupled. As a result, a thrust force of which is opposite in direction to the thrust force generated when those couplings are coupled is generated at the meshing part between the drive shaft gear 72 and the drive coupling gear 73. In this way, those may be decoupled one from the other.

Where such a coupling removal mechanism is employed, there is no need of using additional parts exclusively used for the decoupling of the couplings. Accordingly, the coupling removal mechanism is simplified correspondingly.

An operation of the thus constructed image forming apparatus which is the embodiment of the invention, will be described.

As shown in FIG. 2, in the process cartridge 40, the photosensitive drum 31 is charged by the charging unit 32, and after a latent image is formed on the photosensitive drum 31 by the exposure unit 33, and it is visualized (into a toner image) by the developing unit 34.

A recording sheet is fed to the sheet transporting path 23 at a predetermined timing, from the sheet supply unit 22, and it is positioned by the register roller 24 and then to a transfer stage.

The toner image is transferred from the photosensitive drum 31 onto the recording sheet by the transfer unit 35, and the toner image, not yet fixed, is fused and fixed on the recording sheet by the fixing unit 25, and the sheet having undergone the fixing process is discharged into the discharge tray 27. The residual toner on the photosensitive drum 31 is removed by the cleaning unit 36.

During such an image forming process, a scanning light beam emitted from the exposure unit 33 reaches the latent image writing position P on the photosensitive drum 31, through the scanning passage 62 of the process cartridge 40. Therefore, there is no chance that the process cartridge 40 impairs the exposure scanning performance of the exposure unit 33.

In the developing unit 34, as the image forming process progresses, the amount of toner consumption increases, and new tone is successively replenished from the toner replenishment box 63 to the developing housing 51 by way of the toner replenishment duct 65 in accordance with an algorithm of toner replenishment control unit, not shown.

The new toner replenished into the developing housing 51, and the developer in the developing/housing 51 is agitated and mixed together by the agitating/transporting augers 53 and 54. The thus mixed one is supplied to the developing roll 52, while retaining a predetermined charging characteristic. The developer held by the developing roll 52 is supplied to the developing area associated with the photosensitive drum 31.

In the developing unit 34, part of the developer in the developing housing 51 is not used for the development, and circulated within the developing housing 51 by the agitating/transporting augers 53 and 54.

Such an developer has been deteriorated and it is difficult for the developer to retain the charging characteristic. In the embodiment, the waste developer (mainly deteriorated developer) is discharged from the discharge port 512 of the developing housing 51 periodically or predetermined timings.

The waste developer, as shown in FIGS. 4 and 5, is transported into the recovering fin 663 in the waste developer transporting mechanism 66, and dropped into and collected by the waste developer recovering box 64 through the recovering port 641 of the waste developer recovering box 64, and is agitated by the smooth agitator 642.

Figure 9:
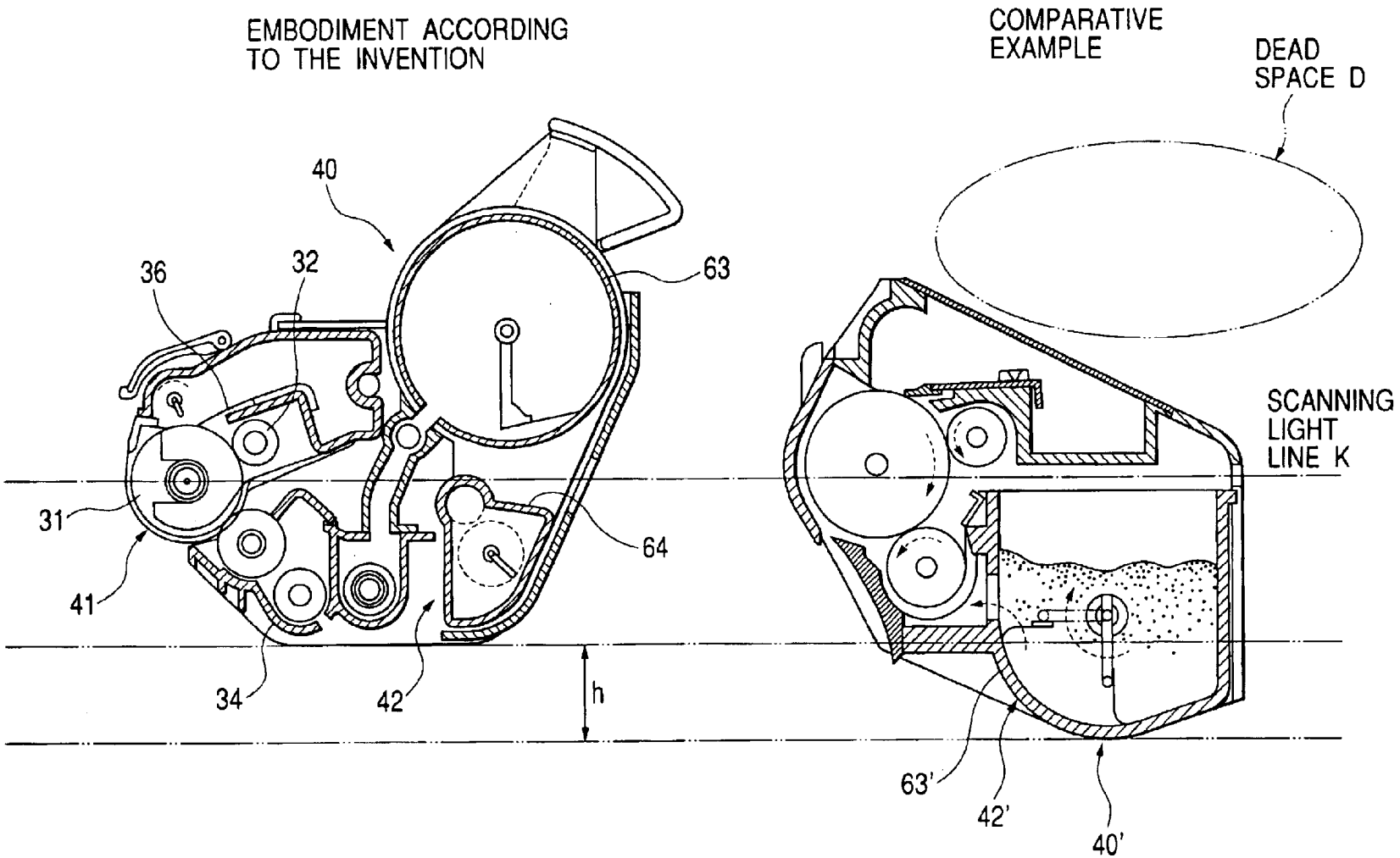
FIG. 9 is a diagram comparatively showing a layout inclusive of the process cartridge in the embodiment and a layout inclusive of the process cartridge, which is illustrated for comparative purpose.

A layout of the process cartridge 40 within the apparatus body 20 is shown in FIG. 9.

A comparative example used here is a process cartridge 40' incorporating thereinto a toner cartridge 42' (equipped with only a toner replenishment box 63 in this instance), which is located downstream (on the lower side in this instance) of the latent image writing position P on the photosensitive drum 31. The process cartridge 40 of the embodiment is compared with the process cartridge 40' of the comparative example. The bottom of the process cartridge 40 of the instant embodiment is higher than that of the comparative example by "h". With this feature, there is eliminated a layout limit imposed onto the sheet supply unit 22 and the like, which are disposed in a lower part of the apparatus body 20.

In the embodiment, the toner replenishment box 63 is disposed upstream (on the upper side in this instance) of the latent image writing position P on the photosensitive drum 31. Therefore, a space occupied by the process cartridge in an upper part of the scanning light line "k" in the apparatus body 20 is increased and larger than that in the comparative example.

As recalled, in the comparative example, the space in the lower part of the discharge tray 27 within the apparatus body 20 is the dead space D. The instant embodiment effectively utilizes this dead space D, and uses it merely as a space occupied by the toner replenishment box 63. Therefore, when the process cartridge 40 of the embodiment is used, there is no need of greatly changing the specifications on the upper part of the apparatus body 20.

Even in such a case of increasing the toner replenishing amount of the toner replenishment box 63, if the space of the upper part within the apparatus body 20 is effectively used, it is required to little change the specifications on the upper part (vicinal region around the discharge tray 27) of the apparatus body 20.

For this reason, in constructing the image forming apparatuses of various specifications, the apparatus body 20 may be used in common for those different image forming apparatuses.

Even in a case where the upper part specifications of the apparatus body 20 are unavoidably changed, such a minute change of the specifications as somewhat raising of the discharge tray 27, suffices. As in the comparative example where the space in the lower part of the apparatus body 20 is limited, the specification must greatly be changed, for example, the layout in the sheet supply unit 22 is changed. In the instant embodiment, by contrast, there is no need of greatly changing the specifications.

The attaching and detaching operations of the process cartridge 40, which is constructed according to the invention, will be described hereunder.

In the embodiment, a cartridge receiving part 80 to and from which the process cartridge 40 is attached and detached is provided within the apparatus body 20. The cartridge receiving part 80 is provided with a guide part 81 which consists of, for example, a groove. A guided part of the cartridge holder 401 of the process cartridge 40 slidably engages the groove.

Also in the embodiment, a part of the bottom wall of the discharge tray 27 is formed as an opening/closing cover 82. An opening formed when the opening/closing cover 82 is opened, is used as a work opening 83, which is used for the attaching and detaching operations of the process cartridge 40.

Figure 10:
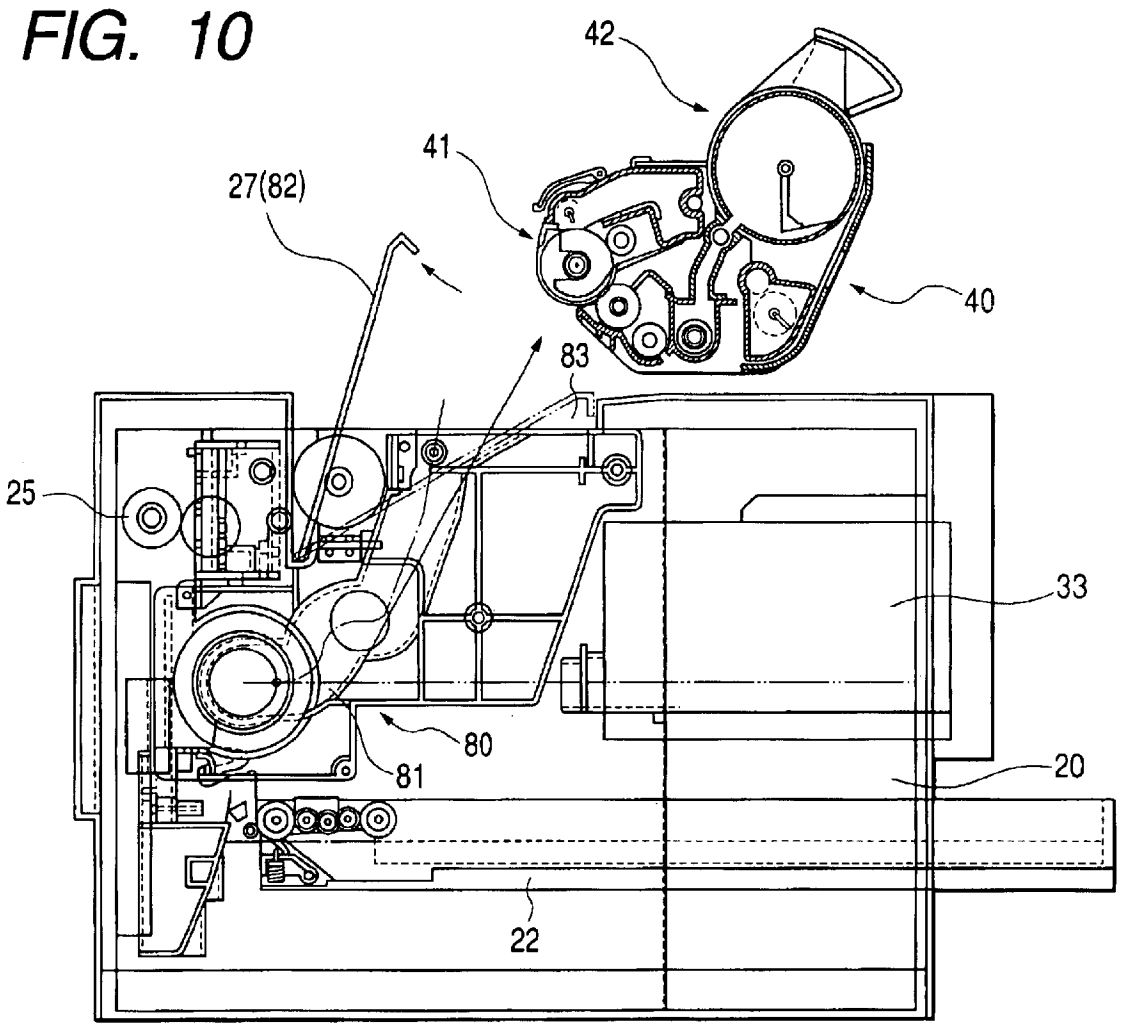
FIG. 10 is an explanatory diagram for exemplarily explaining the attaching/detaching of the process cartridge constructed according to the embodiment.

To pulled out the process cartridge 40 from the apparatus body 20, as shown in FIG. 10, for example, the opening/closing cover 82 is opened, and one pulls out the process cartridge 40 from the cartridge receiving part 80 of the apparatus body 20, through the work opening 83.

Figure 11:
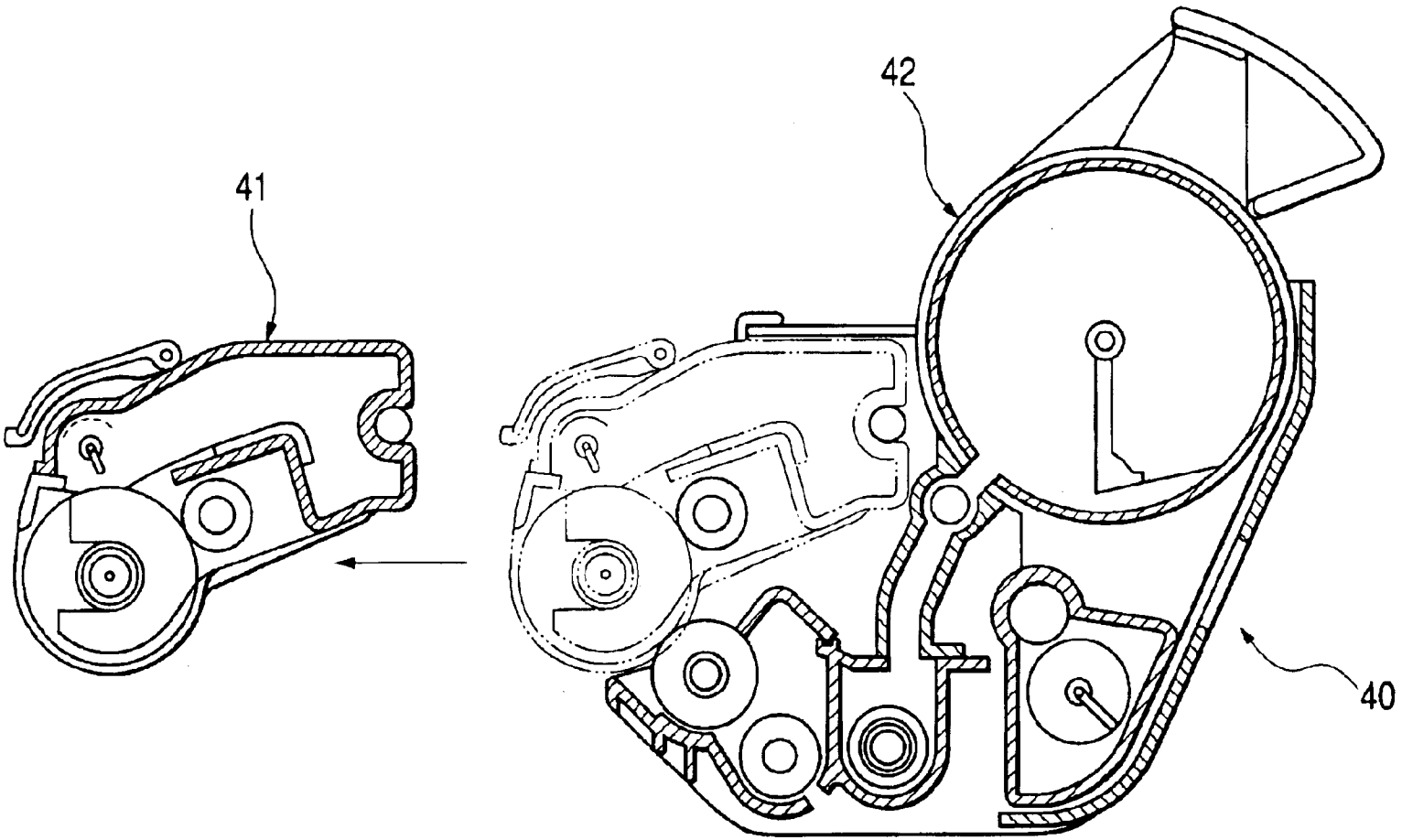
FIG. 11 is an explanatory diagram for explaining a relationship between the process cartridge and a photosensitive cartridge.

In this state, when the photosensitive cartridge 41, for example, is replaced with another cartridge, one removes the photosensitive cartridge 41 from the process cartridge 40 as shown in FIG. 11.

As shown in FIG. 3, the cartridge case 411 of the photosensitive cartridge 41 includes an engaging part 412, which may engage with and disengage from engaged parts 403 in the cartridge holder 401. With the aid of the engaging part, the cartridge case is positioned to and detachably attached to the cartridge holder 401.

In the embodiment, the toner cartridge 42 may be detached from the process cartridge 40.

Figure 12:
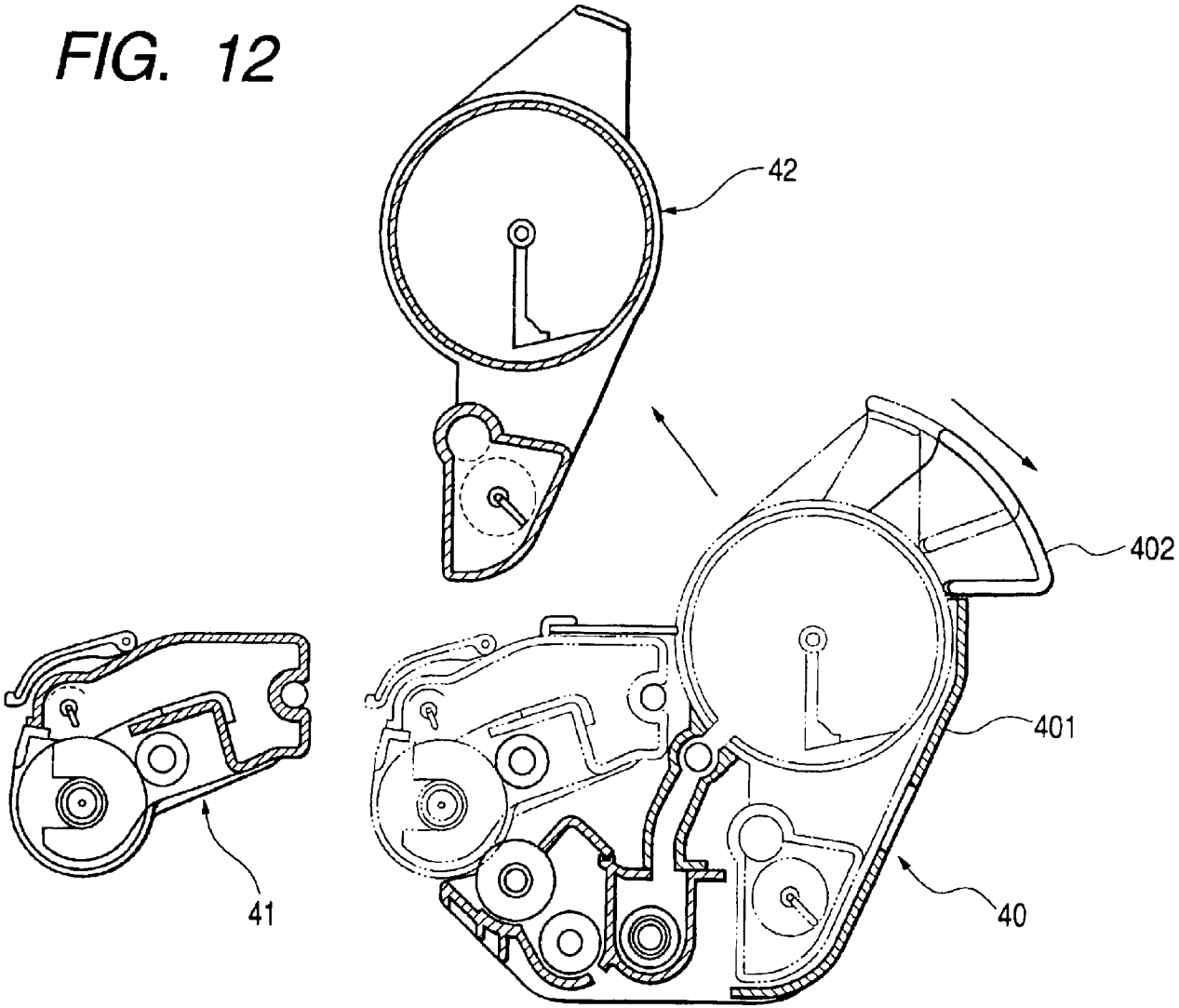
FIG. 12 is an explanatory diagram for explaining a relationship among the process cartridge, developer replenishment box, and waste developer recovering box.

In this case, as shown in FIG. 12, the movable holder 402 of the cartridge holder 401 is turned and moved to release the toner cartridge 42 from its constrained state by the movable holder 402. Thereafter, one pulls the toner cartridge 42 upward from the cartridge holder 401.

Figure 13:
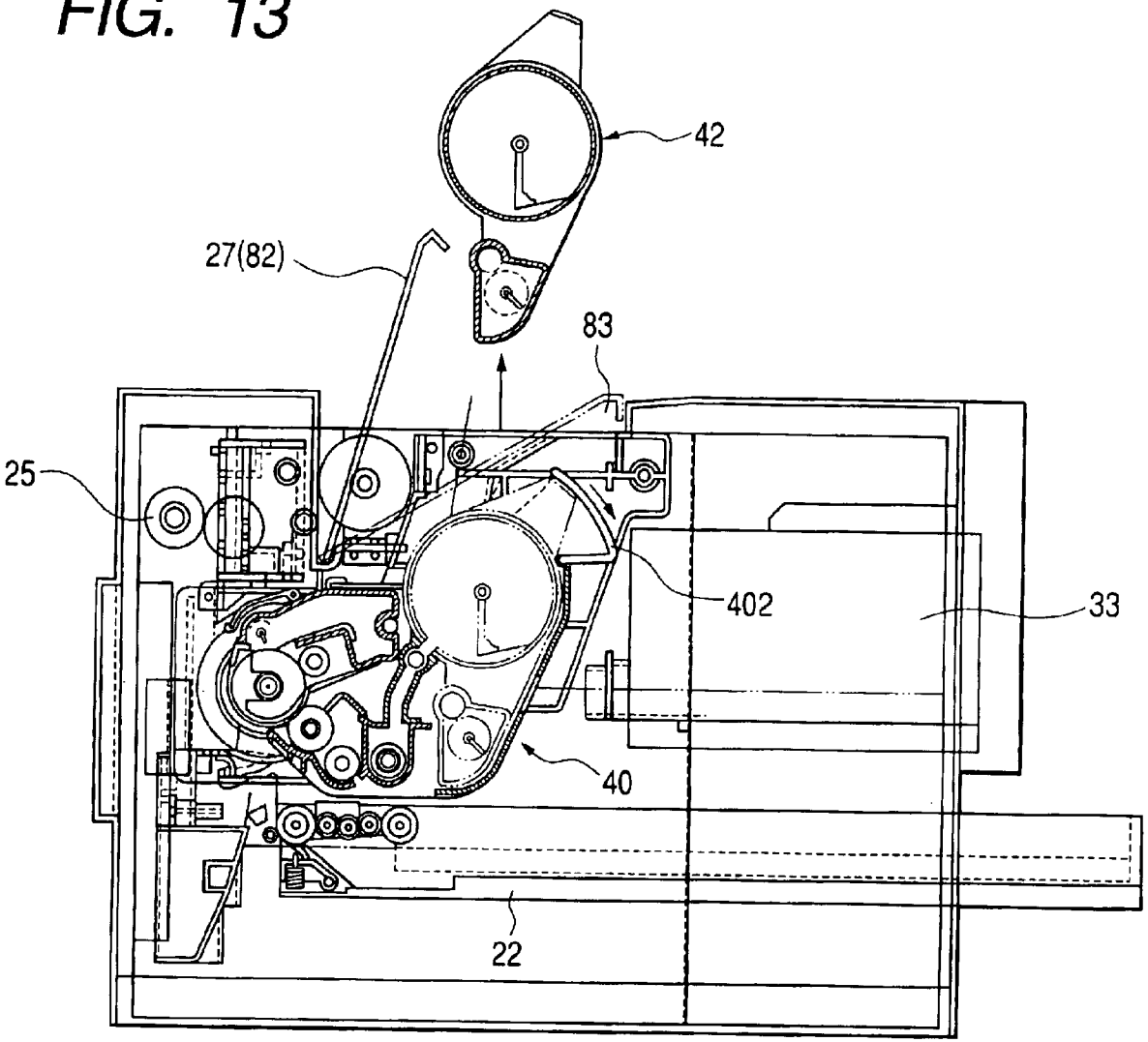
FIG. 13 is an explanatory diagram for exemplarily explaining the replacing work of the developer replenishment box and the waste developer recovering box.

In the embodiment, the toner cartridge 42 may be replaced with another cartridge after the process cartridge 40 is pulled out of the developing unit apparatus body 20. The toner cartridge 42 may be replaced, without taking the process cartridge 40 off the apparatus body 20, in a manner that as shown in FIG. 13, the restraining state of the toner cartridge 42 by the movable holder 402 is removed, and thereafter, the toner cartridge 42 is pulled out the toner cartridge 42 from the process cartridge 40 in the upward direction. When this method is used, the replacing work of the toner cartridge 42 is maintained in good conditions.

Particularly, in the instant embodiment, the photosensitive cartridge 41 and the toner cartridge 42 are detachably attached to the process cartridge 40, and hence the life times of those cartridges are different from one another. However, it is preferable to use those cartridges till those are expired in life time.

In the embodiment, the toner replenishment box 63 and the waste developer recovering box 64 are incorporated into the toner cartridge 42. Therefore, if the toner cartridge 42 is replaced with another toner cartridge, the toner replenishment box 63 and the waste developer recovering box 64 are also replaced both at once with new ones.

Accordingly, in the embodiment, there is no need of using an additional cartridge for collecting the waste toner. In this respect, the operability improvement and the cost reduction are both achieved. A replenishment toner emptiness is detected and the replacing timing of the toner cartridge 42 is determined by using the emptiness. Therefore, there is no need of detecting the waste developer fullness of the waste developer recovering box 64.

Figure 14:
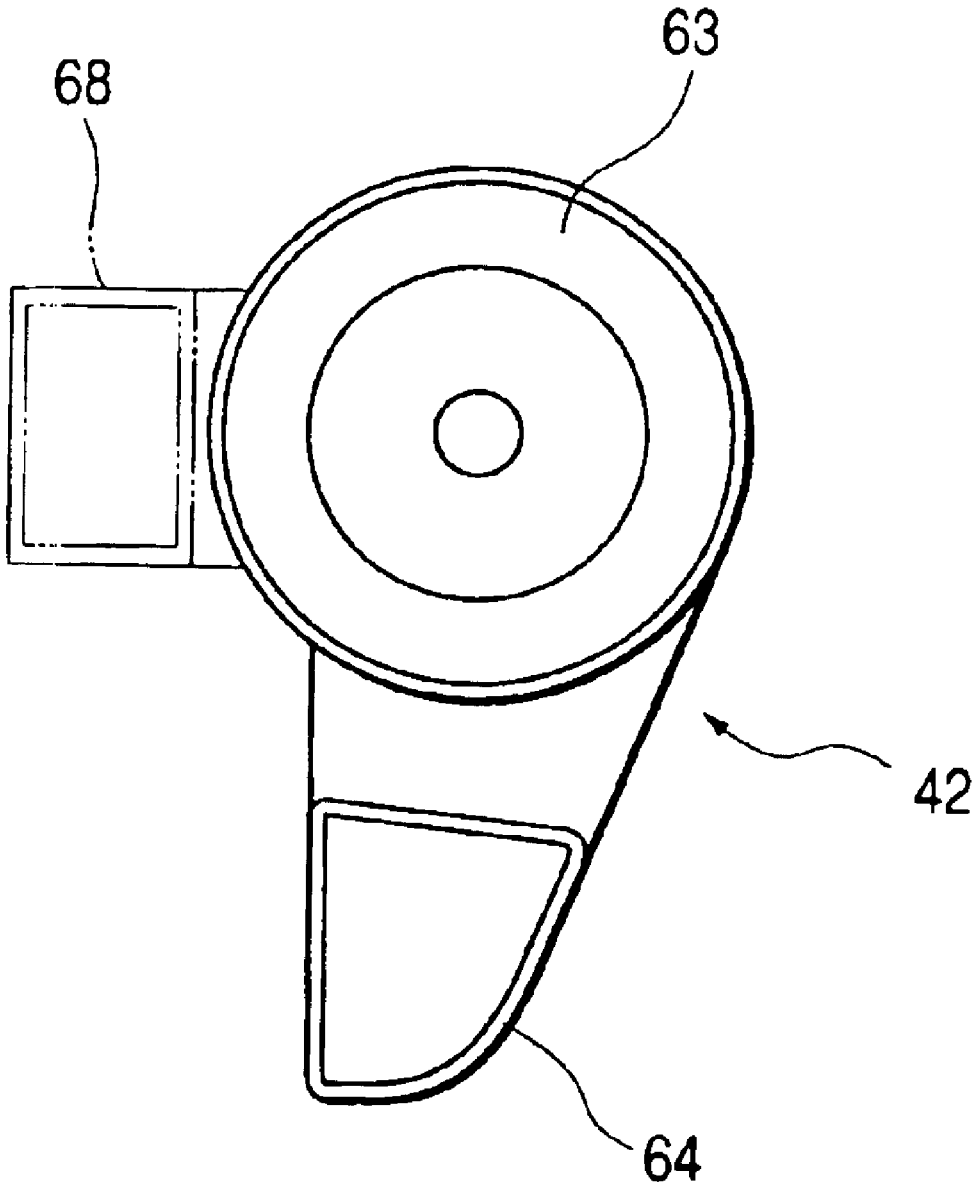
FIG. 14 is an explanatory diagram for explaining modifications of the developer replenishment box and the waste developer recovering box.

In the embodiment, the toner cartridge 42 is provided with the toner replenishment box 63 and the waste developer recovering box 64. If necessary, a waste developer recovering box 68 which receives waste toner from the cleaning unit 36 and stores the waste toner may be attached additionally, for example, as shown in FIG. 14.

<Embodiment 2>

Figure 15:
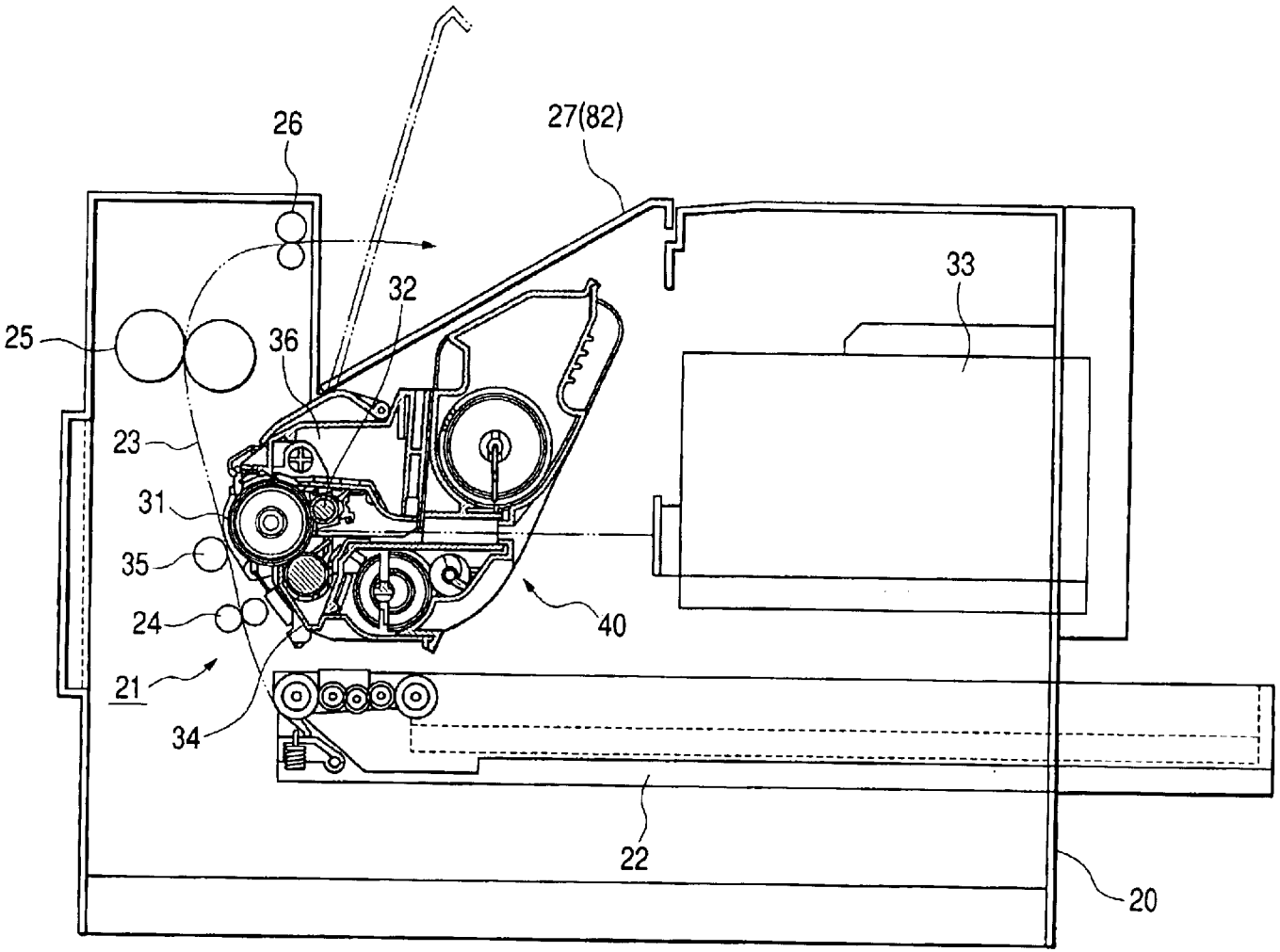
FIG. 15 is an explanatory diagram for explaining an overall arrangement of an image forming apparatus which constitutes an embodiment 2 of the invention.

An embodiment 2 of an image forming apparatus according to the present invention is shown in FIG. 15.

In the figure, a basic arrangement of the image forming apparatus, as in the embodiment 1, an image forming engine 21, which is based on the electrophotography, for example, (most of the devices are contained in the process cartridge 40) is provided in the apparatus body 20. A sheet supply unit 22 is disposed under the image forming engine 21 within the apparatus body apparatus body 20. An upper part of the apparatus body 20 is formed as a discharge tray 27. A sheet transporting path 23 is provided on the rear side (corresponding to the left side in FIG. 15) within the apparatus body 20, while being directed substantially vertically. The sheet transporting path 23 receives a recording sheet delivered from the sheet supply unit 22, and leads it to the image forming engine 21 and the discharge tray 27. Difference between the instant embodiment and the embodiment 1 is a mechanical arrangement of the process cartridge 40.

Figure 19:
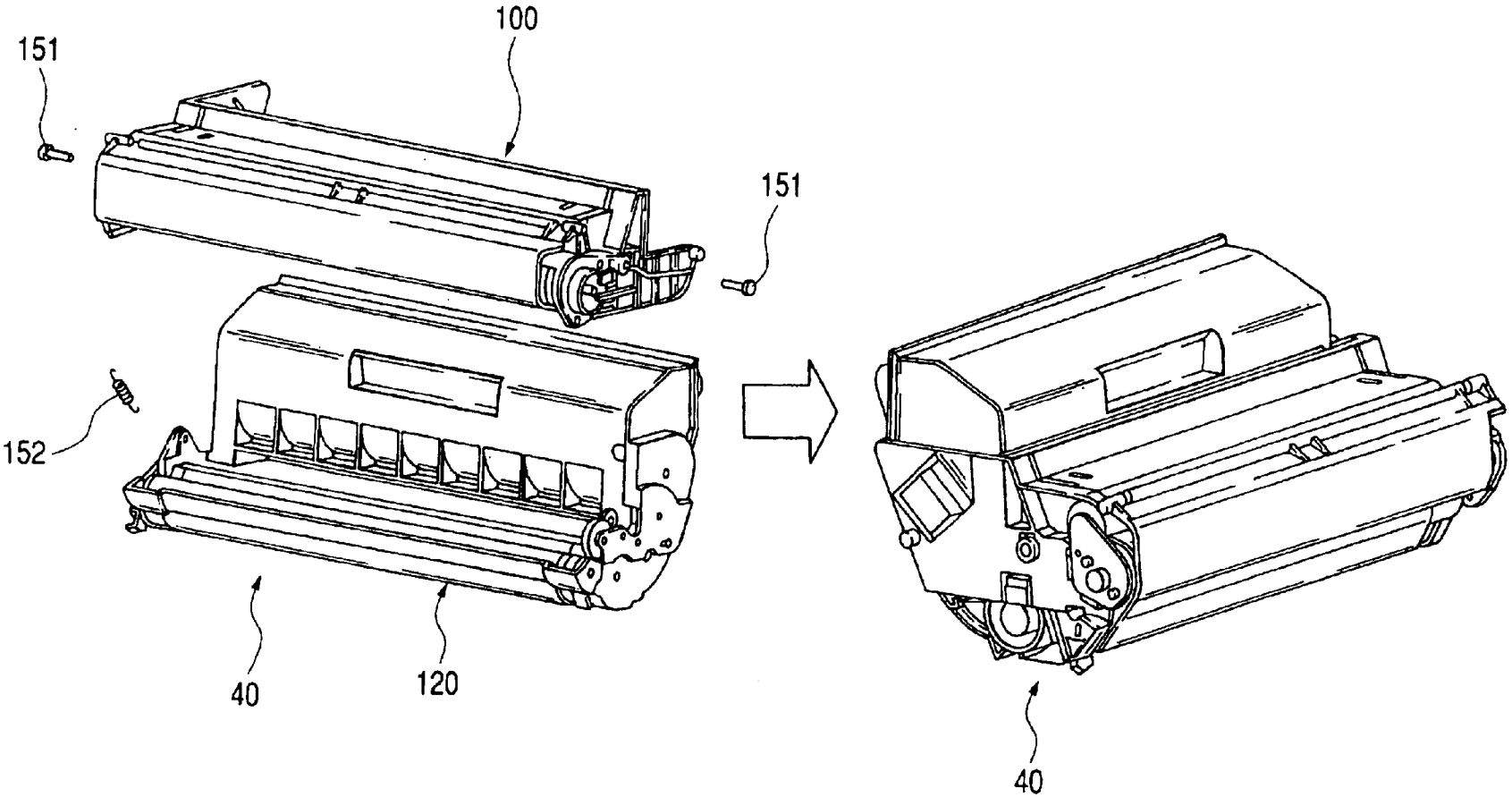
FIG. 19 is an explanatory diagram for explaining a sub-cartridge construction of the process cartridge of the embodiment.

As shown in FIG. 19, a photosensitive cartridge 100 and a developer cartridge 120 are combined into a single unit, or the process cartridge 40. As in the embodiment 1, the opening/closing cover 82 of the upper part of the apparatus body 20 is opened, and the process cartridge is attached to and detached from the apparatus body 20.

In the embodiment, the photosensitive cartridge 100 is supported by pins 151 with respect to the developer cartridge 120 in a swingable fashion, and held while being pressed in a predetermined direction by an urging spring 152.

The components constituting the sub-cartridges 100 and 120, which form the process cartridge 40, will be described in detail.

Figure 16:
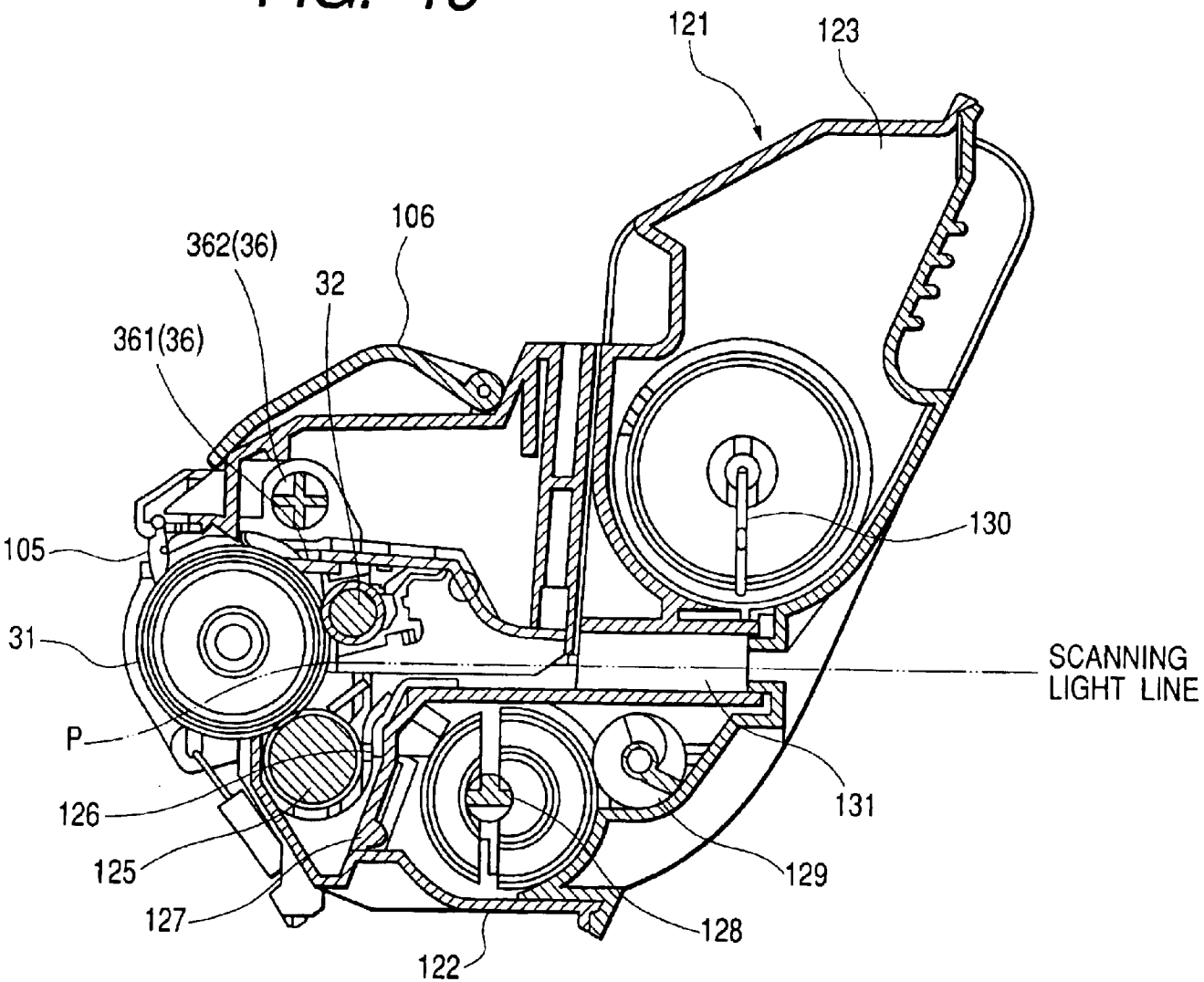
FIG. 16 is a cross sectional view showing the detail of a process cartridge used in the embodiment.
Figure 17:
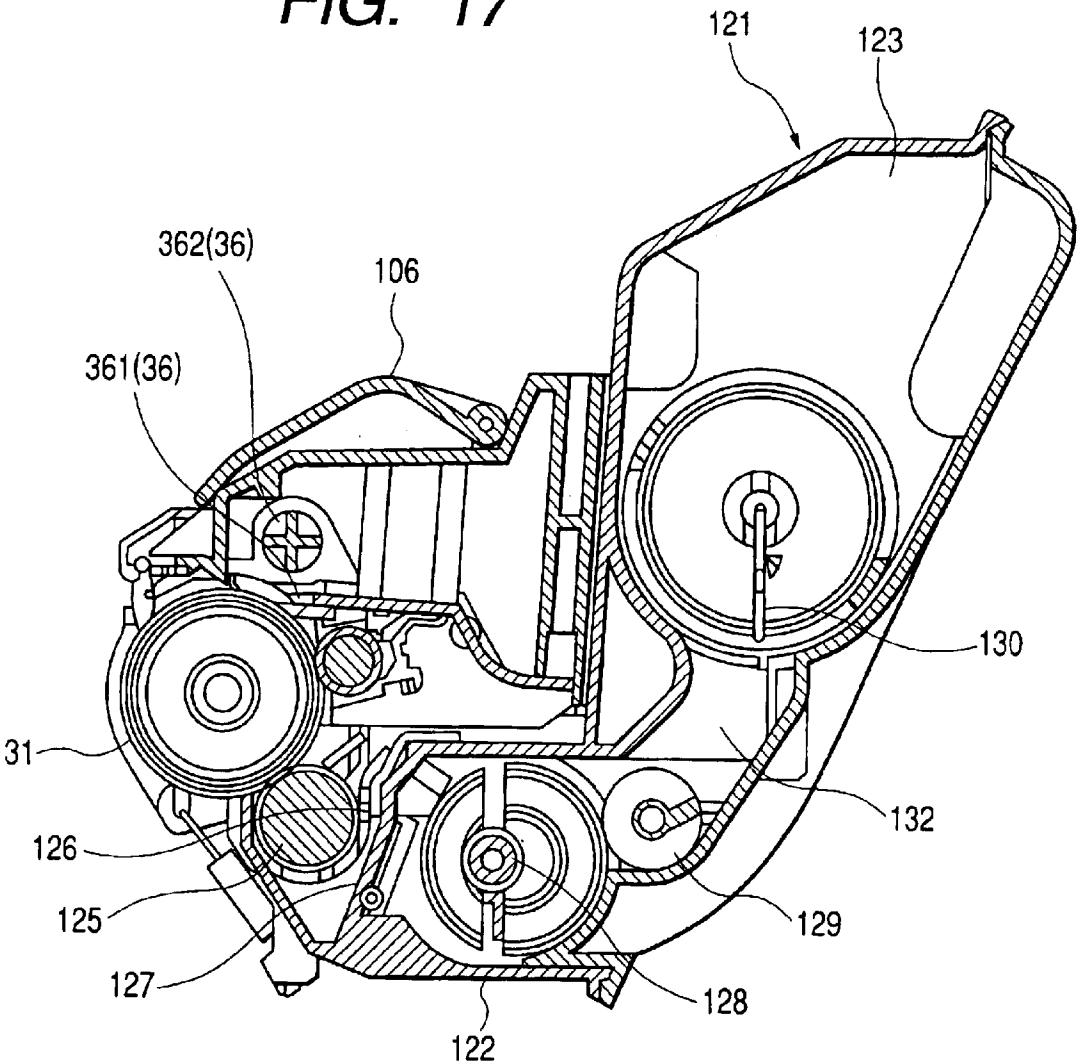
FIG. 17 is a cross sectional view showing the detail of a toner replenishing path portion of the process cartridge used in the embodiment.
Figure 20:
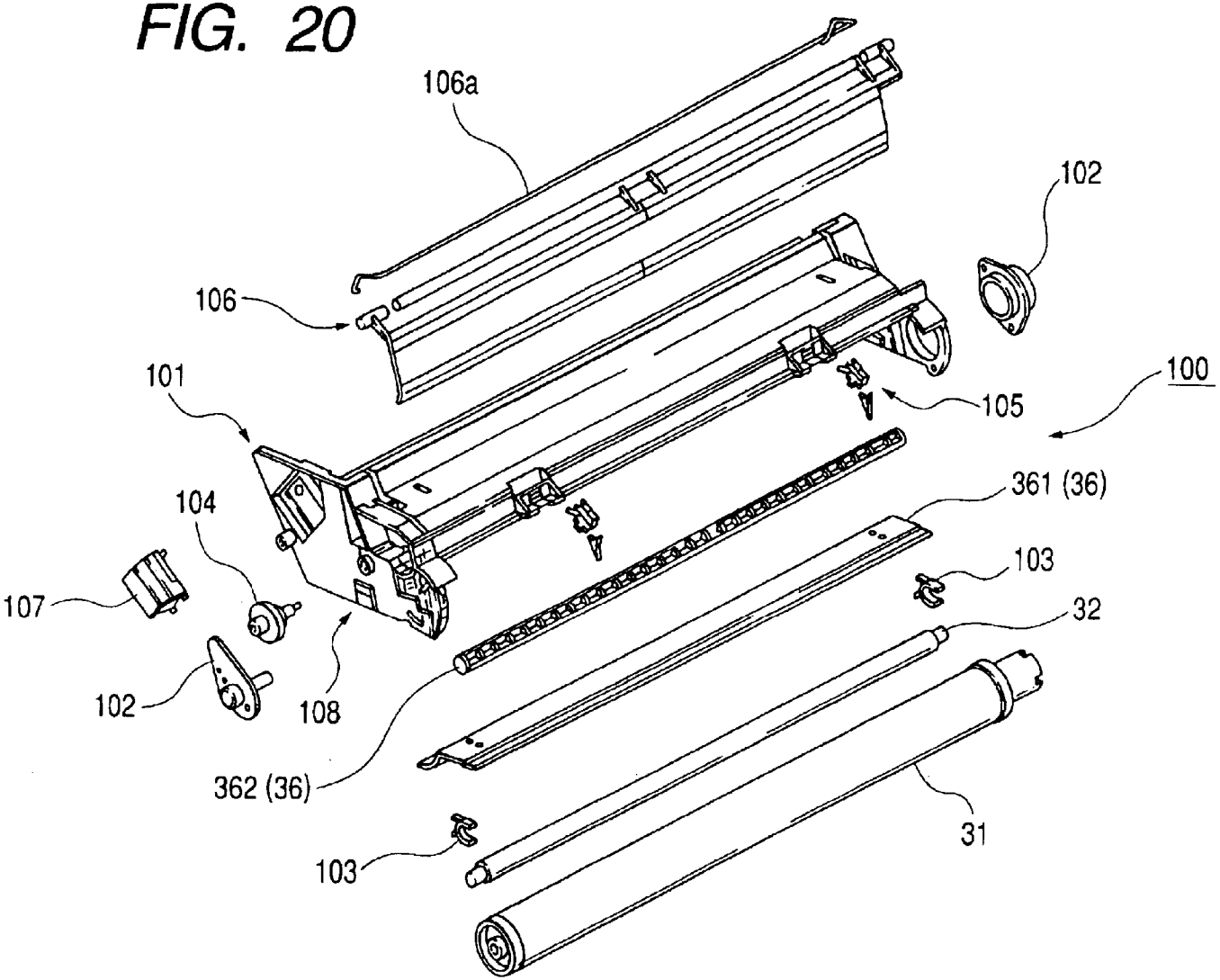
FIG. 20 is a perspective view showing an over-all construction of a developer cartridge, which is based on the invention.
Figure 21:
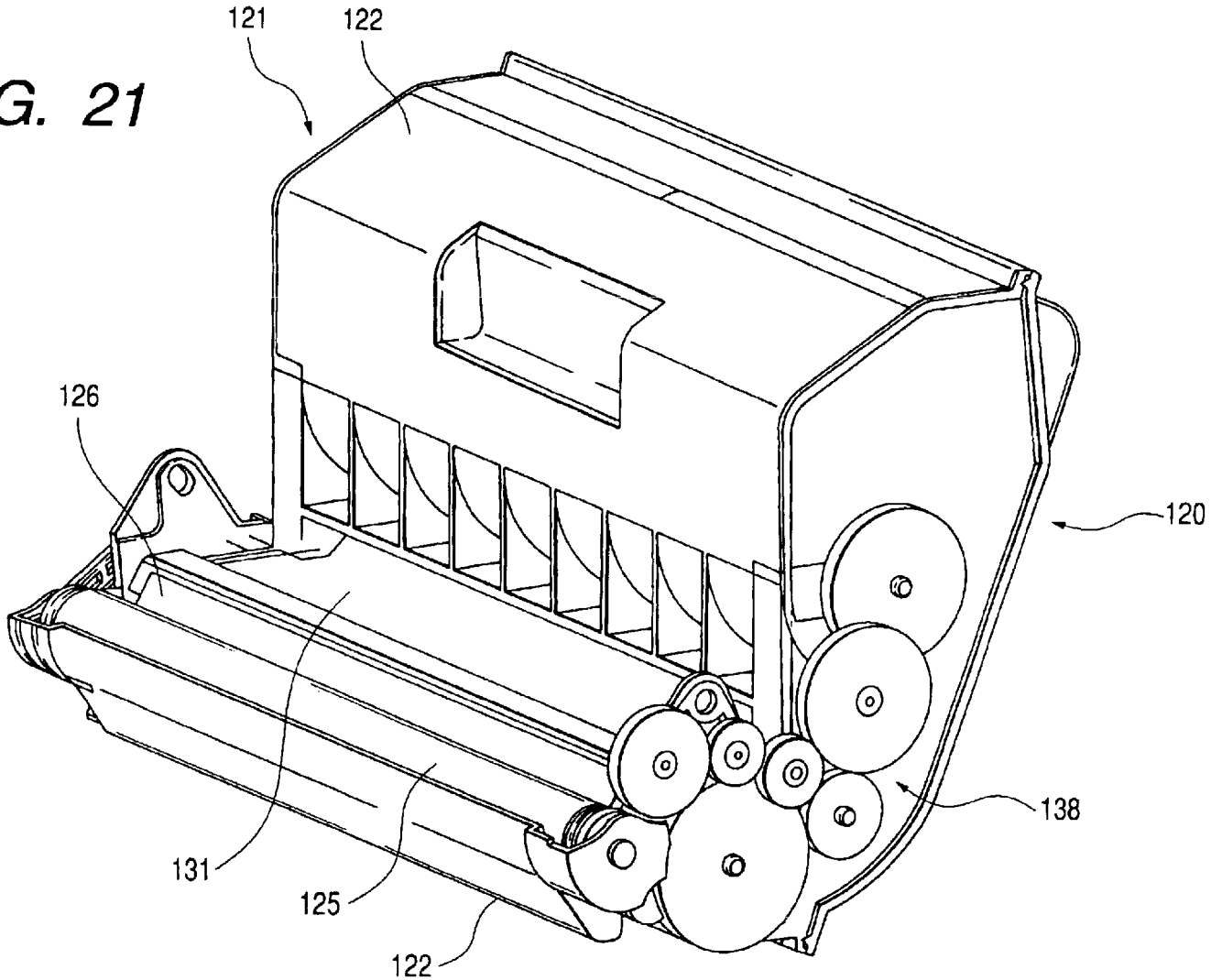
FIG. 21 is an explanatory diagram showing the developer cartridge when the rear cover is removed.

The photosensitive cartridge 100, as shown in FIGS. 16, 17 and 20, has the photosensitive drum 31, the charging unit (charging roll) 32 for charging the photosensitive drum, and the cleaning unit 36 (including the cleaning blade 361 and the transporting paddle 362 in this instance) for cleaning the photosensitive drum 31, which are held in the cartridge case 101.

As shown FIG. 20, the photosensitive drum 31 and the charging unit 32 are rotatably supported on the cartridge case 101, with the aid of a drum bearing 102 and a roll bearing 103. The transporting paddle 362 is driven to rotate through a paddle gear 104. Further, a separation finger 105 for separating the recording sheet is provided downstream of the transfer stage.

In FIG. 20, reference numerals 106 and 106*a* are a shutter provided on the cartridge case 101 and its shaft. The shutter 106 functions to open and close a developing area surface on the photosensitive drum 31. Reference numeral 107 designates a cram assembly for storing information on the photosensitive cartridge 100, and reference numeral 108 designates a feeder plate for feeding electric power from the apparatus body to the charging roll.

The developer cartridge 120 is based on the one-component development, for example. As shown in FIGS. 16, 17, and 21 to 23, the cartridge case 121 is provided with a developing housing 122 and a toner replenishment box 123. A developing roll 125 is disposed at a location opposed to the photosensitive drum. 31 of the developing housing 122. A layer-thickness regulating blade 126 for regulating a thickness of the developer layer is disposed around the developing roll 125. An auxiliary agitator 127 for agitating the toner is disposed on the rear side of the developing roll 125. An agitator 128 for transporting replenishing toner to the developing roll is disposed on its rear side. A dispense auger 129 is further disposed on its rear side, and uniformly transports the toner as supplied to the developing housing 122.

A toner agitator 130 is provided within the toner replenishment box 123, and agitates the replenishing toner and transports it to the toner replenishment ducts 132.

In the embodiment, a scanning passage 131 is formed in the cartridge case 121 at a location between the developing housing 122 and the toner replenishment box 123. The scanning passage 131 allows a scanning light beam emitted from the exposure unit 33 to pass therethrough. The toner replenishment ducts 132 are provided at both end positions out of the scanning passage 131 of the cartridge case 121. The toner replenishment ducts are provided for communicatively connecting the developing housing 122 and the toner replenishment box 123.

Accordingly, in the embodiment, particularly as shown in FIG. 16, the toner replenishment box 123 is disposed in an upstream (on the upper side in this instance) of the latent image writing position P of the photosensitive drum 31. The developing housing 122 is disposed in a downstream (on the lower side in this instance) of the latent image writing position P.

Figure 23:
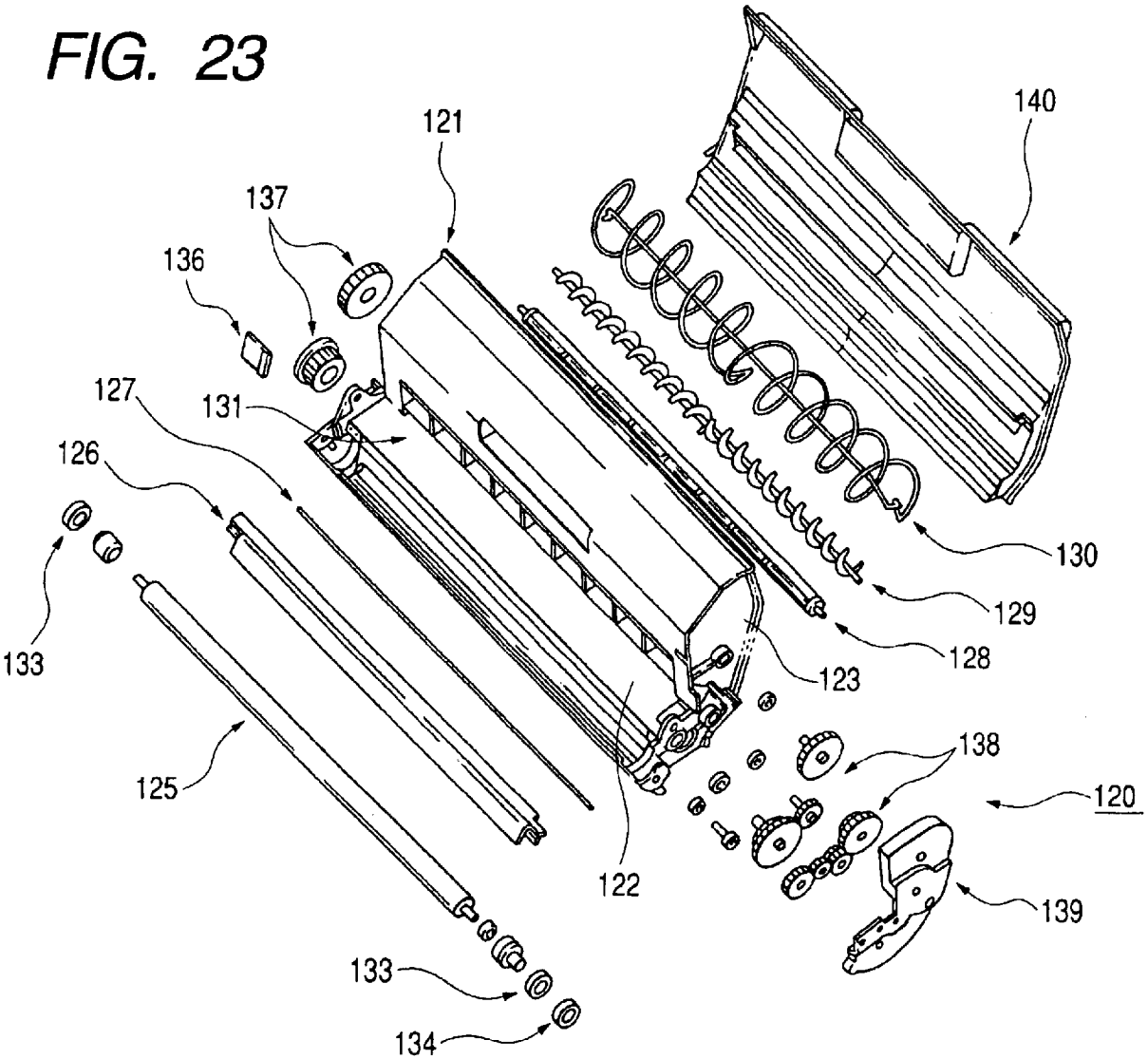
FIG. 23 is an exploded, perspective view showing a photosensitive cartridge 100 used in the embodiment.

In FIG. 23, reference numeral 133 is a tracking cap for adjusting a gap between the developing roll 125 and the photosensitive drum 31; 134 is drive force transmission gear; 136 is a seal member of the developing roll 125; 137 is a toner cap; 138 is a drive force transmission gear train for transmitting a drive force to the agitators; and 139 and 140 are a side cover and a rear cover for covering the side and the rear portions of the cartridge case 121.

Operation of the image forming apparatus thus constructed will be described.

An image forming process in the instant embodiment is substantially the same as in the embodiment 1.

In the image forming process, a scanning light beam emitted from the exposure unit 33 travels through the scanning passage 131 of the process cartridge 40 and reaches the latent image writing position P on the photosensitive drum 31. Therefore, there is no chance that the process cartridge 40 impairs the exposure scanning performance of the exposure unit 33.

In the embodiment, the developing housing 122 of the developer cartridge 120 and the toner replenishment box 123 are vertically separated with respect to the latent image writing position P of the photosensitive drum 31. Those are communicatively coupled with each other by way of the toner replenishment ducts 132 which make a detour around the scanning passage 131. Therefore, the toner replenishing is performed without impairing the exposure scanning performance.

Figure 18:
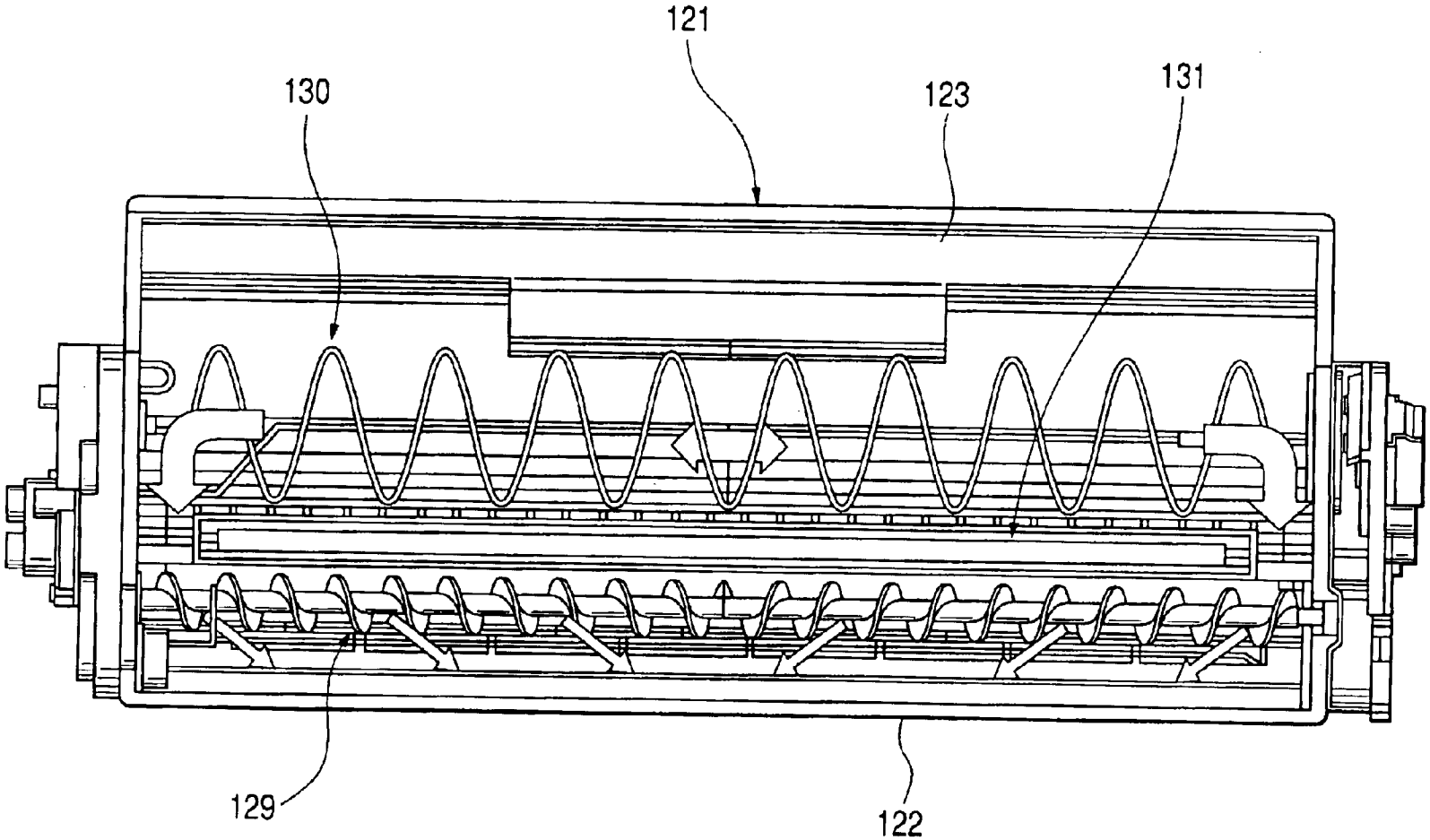
FIG. 18 is an explanatory diagram for explaining the toner replenishing path of the process cartridge of the embodiment, over its axial length.
Figure 22:
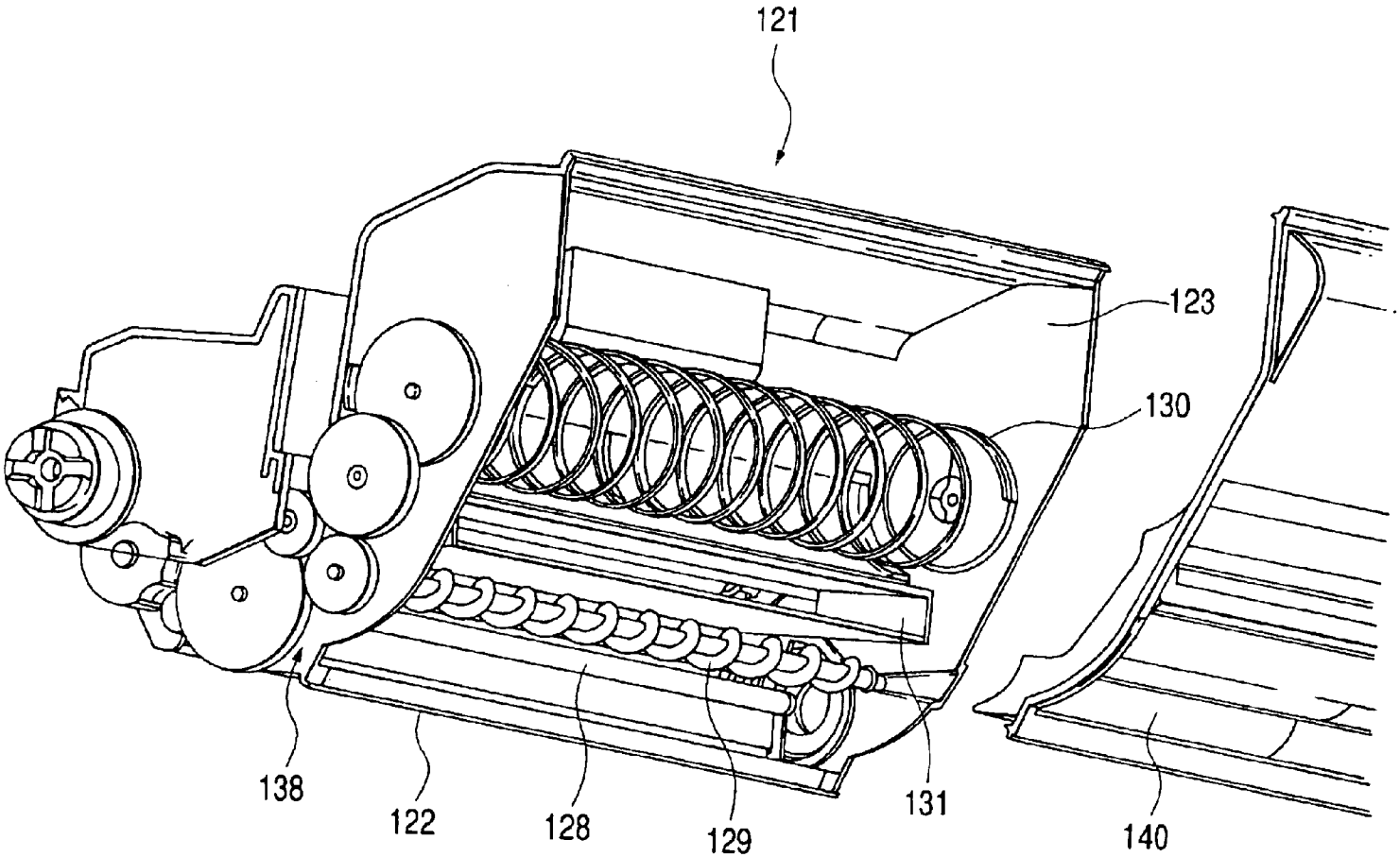
FIG. 22 is an exploded perspective view illustrating a developer cartridge used in the embodiment.

In the developing unit 34, as the image forming process progresses, the toner is consumed in the developing unit 34. However, the toner in the toner replenishment box 123, as shown in FIGS. 18 and 22, for example, is transported to the dispense auger 129 part of the developing housing 122 by way of the toner replenishment ducts 132, and is successively supplied into the developing housing 122 with rotation of the dispense auger 129.

Thereafter, as shown in FIGS. 16 and 17, the new toner supplied into the developing housing 122 is transported to the developing roll by the agitator 128, and agitated by the auxiliary agitator 127 and supplied to the developing roll 125. The developer held by the developing roll 125 is regulated in thickness by the layer-thickness regulating blade 126, and then supplied to the developing area associated with the photosensitive drum 31.

In this way, with progress of toner consumption, the toner replenishing operation is performed.

In this embodiment, the toner replenishment box 123 is disposed in the upper part of the latent image writing position P of the photosensitive drum 31. Therefore, the bottom of the process cartridge 40 may be set to be higher than that in the case where it is disposed in the lower part. With this feature, as in the embodiment 1, there is eliminated a layout limit imposed onto the sheet supply unit 22 and the like, which are disposed in a lower part of the apparatus body 20.

In the instant embodiment, the toner replenishment box 123 is disposed upstream (on the upper side in this instance) of the latent image writing position P of the photosensitive drum 31. Accordingly, a space occupied by the process cartridge in an upper part of the scanning light line in the apparatus body 20 is increased and larger than that in the comparative example. As in the embodiment 1, the space in the lower part of the discharge tray 27 within the apparatus body 20 is the dead space D. The embodiment merely effectively utilizes the dead space, and hence there is no need of greatly changing the specifications of the upper part of the apparatus body 20.

Even in such a case of increasing the toner replenishing amount of the toner replenishment box 123, if the space of the upper part within the apparatus body 20 is effectively used, it is required to little change the specifications on the upper part (vicinal region around the discharge tray 27) of the apparatus body 20.

For this reason, in constructing the image forming apparatuses of various specifications, the apparatus body 20 may be used in common for those different image forming apparatuses.

Even in a case where the upper part specifications of, the apparatus body 20 are unavoidably changed, such a minute change of the specifications as somewhat raising of the discharge tray 27, suffices.

<Embodiment 3>

Figure 24:
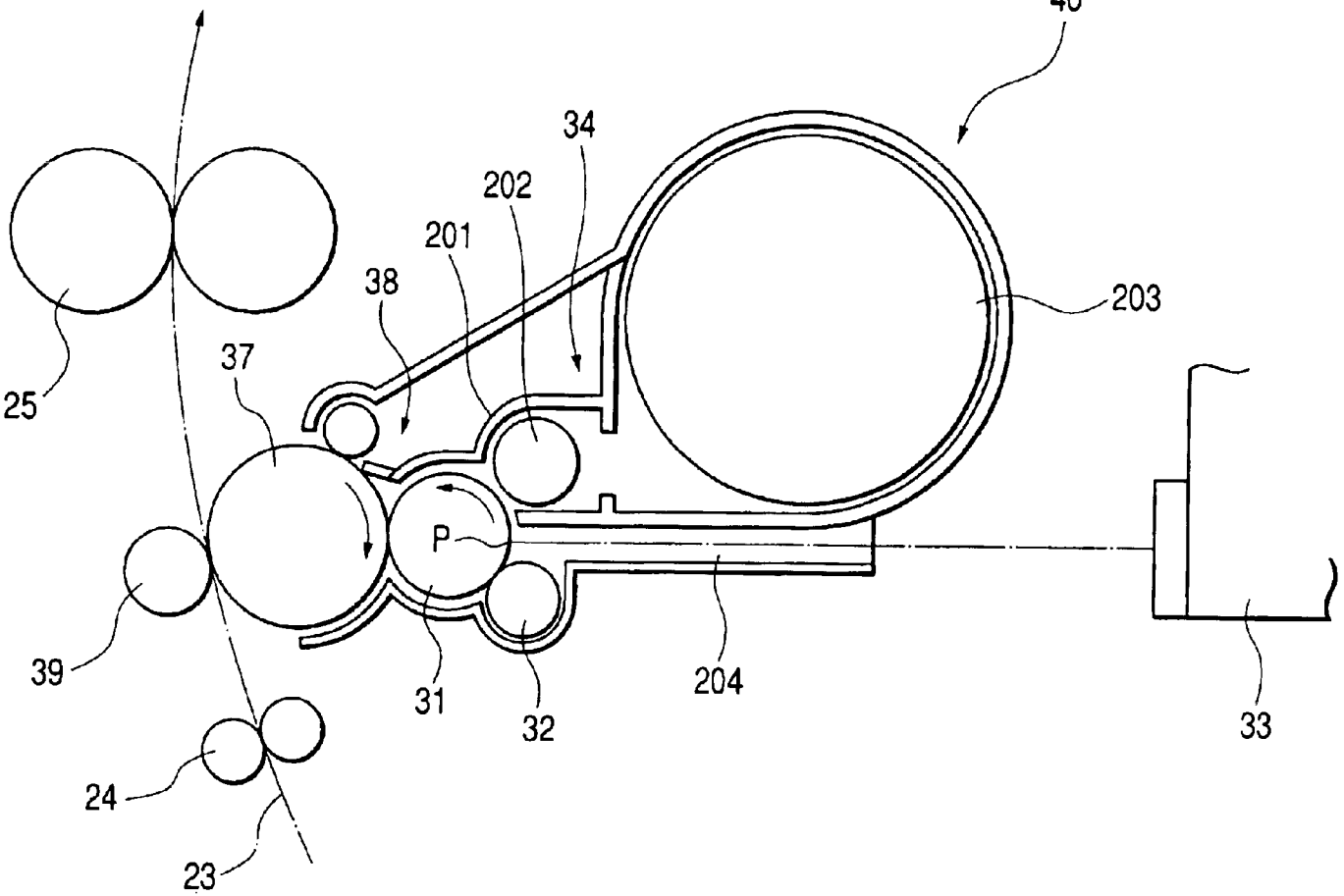
FIG. 24 is an explanatory diagram showing an overall construction of an image forming apparatus according to an embodiment 3 of the invention.

FIG. 24 is a diagram showing an embodiment 3 of an image forming apparatus according to of the invention.

In the figure, as in the embodiment 1, the image forming apparatus is arranged such that the recording sheet is transported upward along the substantially vertical direction. The embodiment uses the process cartridge 40, which is different from that in the embodiments 1 and 2. In the embodiment, like reference numerals are used for designating like or equivalent constituent components in the embodiments 1 and 2, and hence the detailed description of them are omitted.

In the instant embodiment, the process cartridge 40 includes a photosensitive drum 31, a charging unit 32 (charging roll in this instance) for charging the photosensitive drum 31, a developing unit 34 for developing the latent image written onto the photosensitive drum 31, an intermediate transfer drum 37 for temporarily holding the visual image formed on the photosensitive drum 31, and a cleaning unit 38 for removing toner left on the photosensitive drum 31. In the figure, reference numeral 39 denotes a transfer device (transfer roll in this instance) for transferring a visual image (toner image) from the intermediate transfer drum 37 onto the recording sheet.

In particular, in the embodiment, the developing unit 34 is designed to be capable of supplying toner. A developing roll 202 is incorporated into the developing housing 201. A toner replenishment box 203 is communicatively connected to the developing housing 201. The developing housing 201 and the toner replenishment box 203 are disposed in an upper part (downstream in this instance) of the latent image writing position P on the photosensitive drum 31. In the instant embodiment, the developing method is not limited to the one-component developing system, the two-component developing system or the like. The embodiment employs such a developing system that the developing roll 202, for example, holds the carrier and the carrier holds toner, and the resultant developer is supplied to the developing area.

The charging unit 32 is disposed on the lower side (downstream in this instance) of the latent image writing position P on the photosensitive drum 31.

A scanning passage 204 along which the scanning light beam emitted from the exposure unit 33 passes is secured in the process cartridge 40.

Operation of the thus constructed image forming apparatus of the embodiment will b described.

In FIG. 24, in the process cartridge 40, the photosensitive drum 31 is charged by the charging unit 32, a latent image is formed on the photosensitive drum 31 by the exposure unit 33, and then it is developed into a visual image (toner image) by the developing unit 34.

Thereafter, the visual image on the photosensitive drum 31 is transferred onto the intermediate transfer drum 37.

A recording sheet is fed from a sheet supply unit, not shown, at a predetermined timing to the sheet transporting path 23, and transferred to the transfer stage.

The toner image on the intermediate transfer drum 37 is transferred onto the recording sheet by the transfer unit 39, the toner image not yet transferred is fused and fixed on the recording sheet by the fixing unit 25, and the recording sheet having the toner image fixed thereon is discharged into a discharge tray (not shown). The residual toner on the intermediate transfer drum 37 is removed by the cleaning unit 38. In this case, the brush cleaning system is generally used for the cleaning system of the intermediate transfer drum 37. It is frequent to additionally use a flicker bar for scraping the toner off the brush.

During such an image forming process, a scanning light beam emitted from the exposure unit 33 reaches the latent image writing position P on the photosensitive drum 31, through the scanning passage 204 of the process cartridge 40. Therefore, there is no chance that the process cartridge 40 impairs the exposure scanning performance of the exposure unit 33.

In the developing unit 34, as the image forming process progresses, the amount of toner consumption increases, and new tone is successively replenished from the toner replenishment box 203 to the developing housing 201 in accordance with an algorithm of toner replenishment control unit, not shown, and then is used for the development of the latent image by the developing roll.

In the embodiment, the process cartridge 40 is disposed in an upper part of the latent image writing position P on the photosensitive drum 31. Therefore, if an opening/closing cover (not shown) is provided in an upper part of the apparatus body, one may easily attach the process cartridge 40 to and detach it from the apparatus body by opening the opening/closing cover.

In the embodiment, in the developing unit 34 of the process cartridge 40, the developing housing 201 and the toner replenishment box 203 are disposed in an upper part of the scanning light beam position of the exposure unit 33. Therefore, the upper space of the apparatus body is effectively utilized while being free from the formation of the dead space. Further, for example, in a case where such a change to the specification as to change the toner replenishing amount is required, a designer may readily deal with the specification change by effectively utilizing the upper space of the apparatus body, without little affecting other component parts.

As seen from the foregoing description, the unique and inventive technical idea is introduced to the layout of the developer replenishment box, viz., the developer replenishment box is disposed upstream of the latent image writing position on the charging unit. Therefore, the developer replenishing function is effectively secured while satisfying the size reduction and common usability of the apparatus.

In the invention, the developer replenishment box is disposed upstream of the latent image writing position on the charging unit. In the image forming apparatus of the type in which a recording sheet is transported substantially vertically and upward, the upper space at the latent image writing position is effectively used for the developer replenishment space, while it does not become the dead space. For example, in a case where such a change to the specification as to change the developer replenishing amount is required, a designer may readily deal with the specification change, without little affecting other component parts. And the common usability of the apparatus body is achieved.

According to another aspect of the invention, there is provided an image forming apparatus of the type in which a recording sheet is transported substantially vertically and upward, wherein a developing housing and a developer replenishment box are disposed in an upper part of the latent image writing position on the image carrying body, and an image is transferred onto a recording sheet with the aid of an intermediate transfer body. Therefore, the upper space of the apparatus body may be effectively used for the developer replenishment space. In a case where such a change to the specification as to change the developer replenishing amount is required, a designer may readily deal with the specification change, without little affecting the apparatus body, and the common usability of the apparatus body is realized.

In particular, the lower space of the latent image writing device of the image carrying body is minimized, thereby reducing the vertical dimension of the apparatus.

With use of a process cartridge and a developing unit, which are both used for the image forming apparatus of the invention, it is easy to construct an image forming apparatus which is capable of efficiently securing the replenishing function of the developer while satisfying the requirements of the size reduction and common usability of the image forming apparatus, and with a minimum chance of forming the dead space within the machine.

What is claimed is:

1. An image forming apparatus comprising:

a latent image forming unit for forming a latent image on an image carrying body; and a developing unit for visualizing the latent image formed on the image carrying body by using a developer, wherein a developing housing containing the developer is communicatively connected to a developer replenishment box;

wherein the developer replenishment box is disposed upstream of a latent image writing position on the image carrying body;

wherein a waste developer recovering box is disposed downstream of a latent image writing position on the image carrying body; and wherein the waste developer recovering box is integrally attached to the developer replenishment box.

2. The image forming apparatus according to claim 1, further comprising a process cartridge detachably attached to the apparatus body, the process cartridge into which the image carrying body and at least one process unit are incorporated, wherein the process cartridge includes the developer replenishment box.

3. The image forming apparatus according to claim 2, wherein the developer replenishment box is detachably attached to the process cartridge.

4. The image forming apparatus according to claim 2, wherein an image carrying body cartridge including at least the image carrying body is detachably attached to the process cartridge.

5. The image forming apparatus according to claim 2, wherein the process cartridge is attached to and detached from the apparatus body by opening an opening/closing cover provided in an upper part of the apparatus body.

6. The image forming apparatus according to claim 1, wherein a recording sheet onto which a visual image is transferred from the image carrying body is transported from a lower part to an upper part; and wherein the developer replenishment box is disposed on an upper side of the latent image writing position on the image carrying body.

7. The image forming apparatus according to claim 6, further comprising a discharge tray for accommodating discharged sheets, disposed in an upper part of the developer replenishment box.

8. The image forming apparatus according to claim 7, wherein an upper surface housing of the developer replenishment box is an inclined surface inclined in the same direction as of the discharge tray accommodating the recording sheets.

9. The image forming apparatus according to claim 6, wherein the developer replenishment box is capable of containing a larger amount of developer than the developing housing disposed in a lower side of the latent image writing position on the image carrying body.

10. The image forming apparatus according to claim 6, wherein the developer replenishment box is disposed in an upper part of a latent image writing position on the image carrying body;

wherein the developing housing is disposed in a lower part of the latent image writing position; and wherein the developer replenishment box is communicatively connected to the developing housing by way of a communicative passage, which makes a detour around the latent image writing position.

11. The image forming apparatus according to claim 6, wherein the developing housing is disposed in a lower part of the latent image writing position.

12. The image forming apparatus according to claim 1, wherein a spring presses the latent image forming unit in a predetermined direction.

13. The image forming apparatus according to claim 1, wherein the developing housing and the developer replenishment box are communicatively connected by a path on both sides of the latent image writing position, respectively.

14. An image forming apparatus comprising:

a latent image forming unit for forming a latent image on an image carrying body;

a developing unit for visualizing the latent image formed on the image carrying body by using a developer; and a transfer member used in transferring the visual image formed on the image carrying body and transferring the visual image onto a recording sheet, wherein the recording sheet is transported from a lower part to an upper part;

wherein a developing housing containing the developer is communicatively connected to a developer replenishment box;

wherein the developing housing and the developer replenishment box are disposed in an upper part of a latent image writing position on the image carrying body;

wherein a recording sheet onto which a visual image is transferred from the image carrying body is transported from a lower part to an upper part;

wherein the developer replenishment box is disposed on an upper side of the latent image writing position on the image carrying body;

wherein an upper surface housing of the developer replenishment box is an inclined surface inclined in the same direction as of a discharge tray of an image forming apparatus accommodating the recording sheet; and wherein the discharge tray is disposed in an upper part of the developer replenishment box.

15. An image forming apparatus comprising:

a latent image forming unit for forming a latent image on an image carrying body;

a developing unit for visualizing the latent image formed on the image carrying body by using a developer; and a transfer member for used in transferring the visual image formed on the image carrying body and transferring the visual image onto a recording sheet, wherein the recording sheet is transported from a lower part to an upper part; wherein a developing housing containing the developer is communicatively connected to a developer replenishment box;

wherein the developing housing and the developer replenishment box are disposed in an upper part of a latent image writing position on the image carrying body; and wherein a waste developer recovering box is disposed downstream of a latent image writing position on the image carrying body.

16. An image forming apparatus comprising:

a latent image forming unit for forming a latent image on an image carrying body; and a developing unit for visualizing the latent image formed on the image carrying body by using a developer;

wherein a developing housing containing the developer is communicatively connected to a developer replenishment box;

wherein the developer replenishment box is disposed upstream of a latent image writing position on the image carrying body;

wherein a recording sheet onto which a visual image is transferred from the image carrying body is transported from a lower part to an upper part;

wherein the developer replenishment box is disposed on an upper side of the latent image writing position on the image carrying body;

wherein a discharge tray for accommodating discharged sheets is disposed in an upper part of the developer replenishment box; and wherein an upper surface housing of the developer replenishment box is an inclined surface inclined in the same direction as the discharge tray accommodating the recording sheets.

* * * * *